US010264362B2

(12) United States Patent
Miyoshi

(10) Patent No.: US 10,264,362 B2
(45) Date of Patent: Apr. 16, 2019

(54) ELECTROACOUSTIC TRANSDUCER AND ELECTROACOUSTIC TRANSDUCTION SYSTEM

(71) Applicant: FUJIFILM Corporation, Tokyo (JP)

(72) Inventor: Tetsu Miyoshi, Ashigara-kami-gun (JP)

(73) Assignee: FUJIFILM Corporation, Tokyo (JP)

( * ) Notice: Subject to any disclaimer, the term of this patent is extended or adjusted under 35 U.S.C. 154(b) by 11 days.

(21) Appl. No.: 15/670,688

(22) Filed: Aug. 7, 2017

(65) Prior Publication Data

US 2017/0366902 A1 Dec. 21, 2017

Related U.S. Application Data

(63) Continuation of application No. PCT/JP2016/054739, filed on Feb. 18, 2016.

(30) Foreign Application Priority Data

Feb. 27, 2015 (JP) ..... 2015-039267

(51) Int. Cl.
*H04R 7/12* (2006.01)
*H04R 1/02* (2006.01)
(Continued)

(52) U.S. Cl.
CPC ..... *H04R 17/00* (2013.01); *H04R 1/02* (2013.01); *H04R 1/40* (2013.01); *H04R 7/122* (2013.01);
(Continued)

(58) Field of Classification Search
CPC ... H04R 1/02; H04R 1/40; H04R 7/12; H04R 7/16; H04R 7/122; H04R 17/00; H04R 17/005; H04R 31/003; H04R 2307/025
See application file for complete search history.

(56) References Cited

U.S. PATENT DOCUMENTS 4,127,749 A 11/1978 Atoji et al.
2013/0256581 A1 10/2013 Miyoshi et al.
2014/0210309 A1* 7/2014 Miyoshi ..... H04R 7/04 310/313 A

FOREIGN PATENT DOCUMENTS

JP 53-33613 A 3/1978
JP 2003-244791 A 8/2003
(Continued)

OTHER PUBLICATIONS

Translation of WO 2013/047872, Miyoshi, Tetsu, dated Apr. 4, 2013.*
(Continued)

*Primary Examiner* — Brian Ensey
(74) *Attorney, Agent, or Firm* — Birch, Stewart, Kolasch & Birch, LLP

(57) ABSTRACT

Provided are an electroacoustic transducer capable of stably reproducing a sound with high acoustic quality and widening a frequency band that is able to be reproduced, and an electroacoustic transduction system. In the electroacoustic transducer including: an electroacoustic transduction film including a polymer composite piezoelectric body in which piezoelectric body particles are dispersed in a viscoelastic matrix formed of a polymer material having viscoelasticity at a normal temperature, and two thin film electrodes laminated on both surfaces of the polymer composite piezoelectric body; and an elastic supporter which is disposed to be closely attached to one principal surface of the electroacoustic transduction film so as to cause the electroacoustic transduction film to be bent, a bent portion of the electroacoustic transduction film has a quadrangular shape, a length of a short side of the bent portion is less than or equal to 10 cm, and a length of a long side thereof is greater than or equal to 30 cm.

17 Claims, 31 Drawing Sheets

(51) Int. Cl.

| | |
|---|---|
| ***H04R 17/00*** | (2006.01) |
| ***H04R 1/40*** | (2006.01) |
| ***H04R 7/16*** | (2006.01) |
| ***H04R 31/00*** | (2006.01) |

(52) U.S. Cl.
CPC ..... *H04R 7/16* (2013.01); *H04R 17/005* (2013.01); *H04R 31/003* (2013.01); *H04R 7/12* (2013.01); *H04R 2307/025* (2013.01)

(56) References Cited

FOREIGN PATENT DOCUMENTS

| | | | |
|---|---|---|---|
| JP | 2008-294493 | A | 12/2008 |
| JP | 2009-278498 | A | 11/2009 |
| JP | 2010-212868 | A | 9/2010 |
| JP | 2011-228966 | A | 11/2011 |
| JP | 2012-95193 | A | 5/2012 |
| JP | 2012-142546 | A | 7/2012 |
| JP | 2014-14063 | A | 1/2014 |
| JP | 2015-29270 | A | 2/2015 |
| WO | WO 2009/063905 | A1 | 5/2009 |
| WO | WO 2013/047872 | A1 | 4/2013 |

OTHER PUBLICATIONS

Japanese Notification of Reasons for Refusal for Japanese Application No. 2017-502313, dated Sep. 25, 2018, with English translation.

International Preliminary Report on Patentability and English Translation of the Written Opinion of the International Searching Authority (Forms PCT/IB/326, PCT/IB/373 and PCT/ISA/237) for corresponding International Application No. PCT/JP2016/054739, dated Sep. 8, 2017.

International Search Report and Written Opinion of the International Searching Authority (Forms PCT/ISA/210 and PCT/ISA/237) for International Application No. PCT/JP2016/054739, dated May 10, 2016, including an English translation of the International Search Report.

* cited by examiner

ELECTROACOUSTIC TRANSDUCER AND ELECTROACOUSTIC TRANSDUCTION SYSTEM

CROSS-REFERENCE TO RELATED APPLICATIONS

This application is a Continuation of PCT International Application No. PCT/JP2016/054739 filed on Feb. 18, 2016, which claims priority under 35 U.S.C. § 119(a) to Japanese Patent Application No. 2015-039267 filed on Feb. 27, 2015. The above application is hereby expressly incorporated by reference, in its entirety, into the present application.

BACKGROUND OF THE INVENTION

1. Field of the Invention

The present invention relates to an electroacoustic transducer used for an acoustic device such as a speaker, and an electroacoustic transduction system.

2. Description of the Related Art

In response to thinning of displays such as liquid crystal displays and organic electroluminescence (EL) displays, speakers used in such thin displays are also required to be lighter and thinner. As such a lightweight and thin speaker, it is considered to adopt a sheet-like piezoelectric film having a property that stretches and contracts in response to an applied voltage.

For example, in JP2008-294493A, it is described that a piezoelectric film obtained by performing polarization processing with respect to a monoaxially stretched film of polyvinylidene fluoride (PVDF) at a high voltage is used.

In order to adopt the piezoelectric film as a speaker, it is necessary that a stretching and contracting movement along a film surface is converted into a vibration of the film surface. This conversion from the stretching and contracting movement into the vibration is attained by holding the periphery of the piezoelectric film in a bent state, and thus the piezoelectric film is able to function as a speaker.

However, since the piezoelectric film formed of monoaxially stretched PVDF has an in-plane anisotropy in the piezoelectric properties thereof, when the entire peripheral portion thereof is fixed during bending, the vibration mode is disturbed, and sufficient sound volume and acoustic quality are not able to be obtained. Furthermore, since PVDF has a smaller loss tangent than a general vibration plate for a speaker such as cone paper, a strong resonance is easily generated, and near the resonance frequency determined by a radius of curvature when the film is held while being bent, a large number of peaks and dips occur on the sound pressure and frequency properties. Thus, in a lightweight and thin speaker using the piezoelectric film formed of PVDF, it is difficult to reproduce a sound with high acoustic quality.

Here, the present applicants suggested, as a lightweight and thin speaker capable of reproducing a sound with high acoustic quality, an electroacoustic transduction film including a polymer composite piezoelectric body in which piezoelectric body particles are dispersed in a viscoelastic matrix formed of a polymer material having viscoelasticity at a normal temperature, thin film electrodes formed on both surfaces of the polymer composite piezoelectric body, and protective layers formed on the surfaces of the thin film electrodes, which is disclosed in JP2014-14063A.

SUMMARY OF THE INVENTION

By adopting the polymer composite piezoelectric body in which the piezoelectric body particles are dispersed in the viscoelastic matrix formed of the polymer material having viscoelasticity at a normal temperature, the electroacoustic transduction film described in JP2014-14063A is able to be rigid with respect to a vibration of 20 Hz to 20 kHz, and be extremely flexible with respect to a vibration of less than or equal to a few Hz and has an appropriate loss tangent with respect to vibrations of all frequencies below 20 kHz. Therefore, the resonance points determined by the radius of curvature when the film is held while being bent are not noticeable, and the sound pressure and frequency properties become smooth. Accordingly, it is possible to reproduce a sound with high acoustic quality.

However, it could be seen that since the electroacoustic transduction film described in JP2014-14063A is a single vibration plate, there is a problem that the frequency band that is able to be reproduced with high acoustic quality and sufficient sound volume is slightly narrow.

Here, in JP2008-294493A, it is described that a plurality of filters each having a unique correction pattern are provided to correct a sound signal so as to increase or decrease the amplitude for each frequency band by a predetermined amount, one of the filters is selected according to the measured degree of curvature of the speaker, and the sound signal is corrected by the filter and is output to the speaker, thereby improving the acoustic quality such as frequency properties and sound volume.

However, in the configuration in which the sound signal input to the speaker is corrected, the improvement of the frequency properties and the sound volume is insufficient.

An object of the present invention is to solve such a problem of the related art, and is to provide an electroacoustic transducer capable of reproducing a sound with high acoustic quality and sufficient sound volume in a wide frequency band, and an electroacoustic transduction system.

The present inventors have intensively studied to attain the object, and found that by causing an electroacoustic transducer including an electroacoustic transduction film including a polymer composite piezoelectric body in which piezoelectric body particles are dispersed in a viscoelastic matrix formed of a polymer material having viscoelasticity at a normal temperature, and two thin film electrodes laminated on both surfaces of the polymer composite piezoelectric body, and an elastic supporter which is disposed to be closely attached to one principal surface of the electroacoustic transduction film so as to cause the electroacoustic transduction film to be bent to have a configuration in which a vibration surface of the electroacoustic transduction film has a quadrangular shape, a length of a short side of the vibration surface is less than or equal to 10 cm, and a length of a long side thereof is greater than or equal to 30 cm, a sound with high acoustic quality is able to be reproduced with sufficient sound volume in a wide frequency band, thereby completing the present invention.

That is, the present invention provides an electroacoustic transducer having the following configuration, an electroacoustic transduction system, and an electroacoustic transduction film.

(1) An electroacoustic transducer comprising: an electroacoustic transduction film including a polymer composite piezoelectric body in which piezoelectric body particles are dispersed in a viscoelastic matrix formed of a polymer material having viscoelasticity at a normal temperature, and two thin film electrodes laminated on both surfaces of the polymer composite piezoelectric body; and an elastic supporter which is disposed to be closely attached to one principal surface of the electroacoustic transduction film so as to cause at least a portion of the electroacoustic transduction film to be bent, in which the bent portion of the electroacoustic transduction film has a quadrangular shape, a length of a short side of the bent portion is less than or equal to 10 cm, and a length of a long side thereof is greater than or equal to 30 cm.

(2) The electroacoustic transducer according to (1), in which the elastic supporter is a viscoelastic supporter having viscoelasticity.

(3) The electroacoustic transducer according to (1) or (2), in which the bent portion formed gradually changes in curvature from a center to a peripheral portion.

(4) The electroacoustic transducer according to any one of (1) to (3), in which the electroacoustic transduction film is partitioned into a plurality of regions, and the bent portion is formed in each of the regions.

(5) The electroacoustic transducer according to any one of (1) to (4), further comprising: a pressing member which has at least one opening and presses the electroacoustic transduction film against the viscoelastic supporter, in which a region of the electroacoustic transduction film corresponding to the opening of the pressing member is the bent portion, and the opening has a quadrangular shape, a length of a short side of the opening is less than or equal to 10 cm, and a length of a long side thereof is greater than or equal to 30 cm.

(6) The electroacoustic transducer according to (5), in which the pressing member has openings which are two or more in number.

(7) The electroacoustic transducer according to any one of (1) to (5), in which the electroacoustic transduction film has one bent portion, the electroacoustic transduction film has a quadrangular shape, a length of a short side thereof is less than or equal to 12 cm, and a length of a long side thereof is greater than or equal to 30.2 cm.

(8) The electroacoustic transducer according to any one of (1) to (6), in which the electroacoustic transduction film has bent portions which are two or more in number, and normal vectors of the respective bent portions at center points point in different directions from each other and point outward.

(9) The electroacoustic transducer according to (8), in which the electroacoustic transduction film has two bent portions which are disposed back to back so as to cause the normal vectors of the respective bent portions at the center points to face opposite directions to each other.

(10) The electroacoustic transducer according to (8), in which the electroacoustic transduction film has a plurality of the bent portions which are arranged so that extension directions of long sides of the respective bent portions are aligned, the plurality of the bent portions form a polygonal shape or a petal shape in a cross section perpendicular to the long sides of the bent portions, and the normal vectors of the respective bent portions at the center points are in different directions from each other.

(11) The electroacoustic transducer according to any one of (1) to (10), in which a storage elastic modulus (E') of the electroacoustic transduction film at a frequency of 1 Hz according to dynamic viscoelasticity measurement is 10 to 30 GPa at 0° C. and 1 to 10 GPa at 50° C.

(12) The electroacoustic transducer according to any one of (1) to (11), in which a glass transition temperature of the polymer material at a frequency of 1 Hz is 0° C. to 50° C.

(13) The electroacoustic transducer according to any one of (1) to (12), in which, in the polymer material, a local maximum value at which a loss tangent (Tan δ) at a frequency of 1 Hz according to the dynamic viscoelasticity measurement is greater than or equal to 0.5 is present in a temperature range of 0° C. to 50° C.

(14) The electroacoustic transducer according to any one of (1) to (13), in which the polymer material has a cyanoethyl group, or a cyanomethyl group.

(15) The electroacoustic transducer according to any one of (1) to (14), in which the polymer material has cyanoethylated polyvinyl alcohol as a primary component.

(16) An electroacoustic transduction system comprising: a plurality of the electroacoustic transducers according to any one of (1) to (15), in which normal vectors of the bent portions of the respective electroacoustic transducers at center points point in different directions from each other and point outward.

(17) The electroacoustic transduction system according to (15), in which two electroacoustic transducers are provided, and the normal vectors of the bent portions of the two electroacoustic transducers at the center points point in opposite directions to each other.

(18) The electroacoustic transduction system according to (15), in which the plurality of the electroacoustic transducers are arranged so that extension directions of long sides of the bent portions of the respective electroacoustic transducers are aligned, the plurality of the bent portions form a polygonal shape or a petal shape in a cross section perpendicular to the long sides of the bent portions, and the normal vectors of the respective bent portions at the center points are in different directions from each other.

(19) A subwoofer which uses a space surrounded by a plurality of the electroacoustic transducers in the electroacoustic transduction system according to any one of (16) to (18), as a resonance tube.

(20) The electroacoustic transduction system according to any one of (16) to (19), further comprising: a subwoofer mounted in a space surrounded by a plurality of the electroacoustic transducers.

According to the electroacoustic transducer of the present invention, the electroacoustic transduction system, and the electroacoustic transduction film, a sound with high acoustic quality is able to be reproduced with sufficient sound volume in a wide frequency band.

DESCRIPTION OF THE PREFERRED EMBODIMENTS

Hereinafter, an electroacoustic transducer of the present invention and an electroacoustic transduction system will be described in detail based on the preferred embodiments shown in the accompanying drawings.

Descriptions of the constituent elements described below may be made based on representative embodiments of the present invention, but the present invention is not limited to the embodiments.

In this specification, a numerical range expressed by using "to" means a range including numerical values described before and after "to" as a lower limit and an upper limit.

Figure 1A:
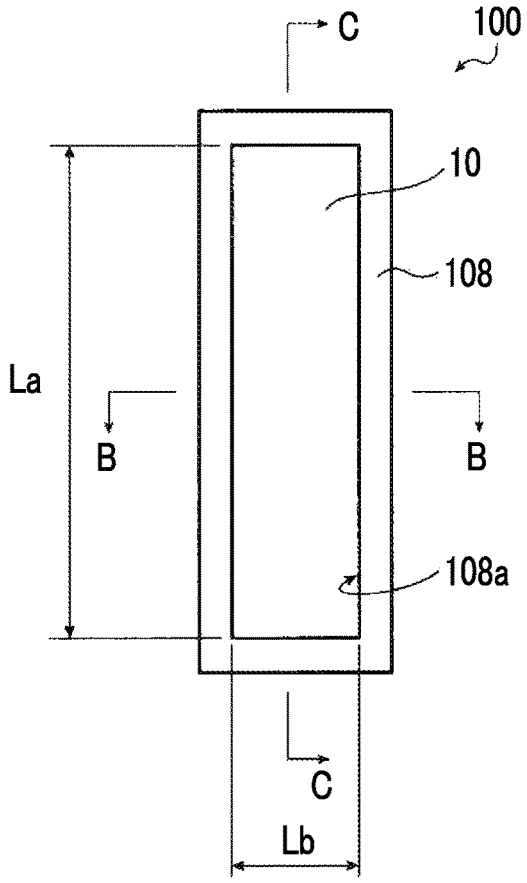
FIG. 1A is a front view conceptually illustrating an example of an electroacoustic transducer of the present invention.
Figure 1B:
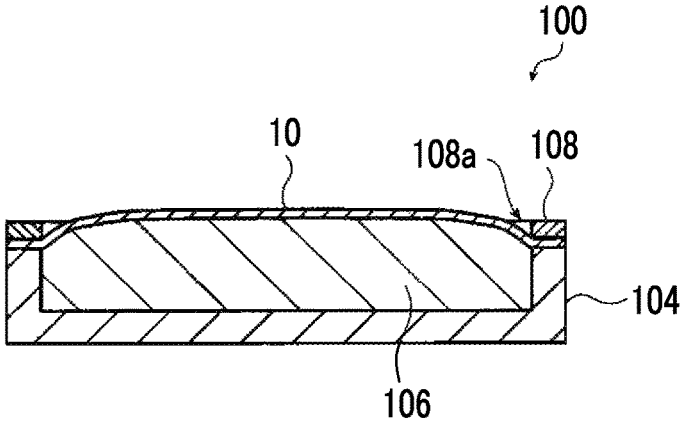
FIG. 1B is a sectional view taken along line C-C of FIG. 1A.
Figure 1C:
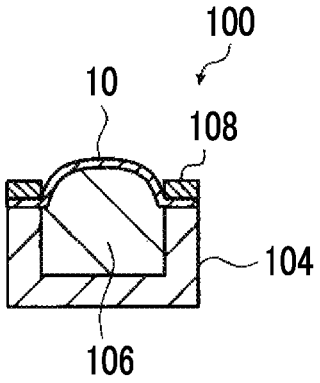
FIG. 1C is a sectional view taken along line B-B of FIG. 1A.

FIG. 1A is a front view conceptually illustrating an example of the electroacoustic transducer of the present invention, FIG. 1B is a sectional view taken along line C-C of FIG. 1A, and FIG. 1C is a sectional view taken along line B-B of FIG. 1A.

As illustrated in FIGS. 1A to 1C, an electroacoustic transducer 100 includes an electroacoustic transduction film (hereinafter, referred to as "transduction film") 10 as a vibration plate, and a viscoelastic supporter 106 for holding the transduction film 10 in a bent state.

In the electroacoustic transducer 100, when the transduction film 10 is stretched in an in-plane direction due to the application of a voltage to the transduction film 10, the transduction film 10 moves upward (in the radial direction of sound) in order to absorb the stretching. Conversely, when the transduction film 10 is contracted in the in-plane direction due to application of a voltage to the transduction film 10, the transduction film 10 moves downward (toward a case 104) in order to absorb the contraction. The electroacoustic transducer 100 performs a conversion between a vibration (sound) and an electrical signal by the vibrations caused by repetition of stretching and contraction of the transduction film 10.

The electroacoustic transducer 100 is used as various acoustic devices such as a speaker, a microphone, and a pickup used in musical instruments including a guitar, and is used for generating, when an electrical signal is input to the transduction film 10, a sound due to a vibration according to the electrical signal or for converting the vibration of the transduction film 10 due to a sound into an electrical signal.

Here, in the electroacoustic transducer 100 of the present invention, a bent portion of the transduction film 10 has a quadrangular shape, in which the length of the short side of the bent portion is less than or equal to 10 cm, and the length of the long side is greater than or equal to 30 cm. Accordingly, the resonance frequencies determined by the radii of curvature of the bent portion are appropriately distributed, and multiple vibration modes suitable for reproducing a sound with high acoustic quality in a wide frequency band are realized.

These points will be described in detail later.

The electroacoustic transducer 100 is configured to include the transduction film 10, the case 104, the viscoelastic supporter 106, and a pressing member 108.

The transduction film 10 is a piezoelectric film which has piezoelectric properties so as to cause the principal surfaces thereof to stretch and contract in response to the state of an electric field, and converts a stretching and contracting movement along a film surface into a vibration in a direction perpendicular to the film surface by being held in a bent state, thereby converting an electrical signal into a sound.

Here, the transduction film 10 used in the electroacoustic transducer 100 of the present invention is a transduction film including a polymer composite piezoelectric body in which piezoelectric body particles are dispersed in a viscoelastic matrix formed of a polymer material having viscoelasticity at a normal temperature, and two thin film electrodes laminated on both surfaces of the polymer composite piezoelectric body.

The transduction film 10 will be described later in detail.

The case 104 is a holding member that holds the transduction film 10 and the viscoelastic supporter 106 together with the pressing member 108, and is a box-shaped case which is formed of plastic or the like and has an open surface. As illustrated in the figure, the open surface has a rectangular shape. The case 104 accommodates the viscoelastic supporter 106 therein.

The viscoelastic supporter 106 has moderate viscosity and elasticity, holds the transduction film 10 in a bent state, and imparts a constant mechanical bias at any place of the transduction film 10 to efficiently convert the stretching and contracting movement of the transduction film 10 into a forward and rearward movement (a movement in the direction perpendicular to the surface of the transduction film).

In the illustrated example, the viscoelastic supporter 106 has a quadrangular prism shape having a bottom shape substantially equal to the bottom surface of the case 104. In addition, the height of the viscoelastic supporter 106 is larger than the depth of the case 104.

The material of the viscoelastic supporter 106 is not particularly limited as long as the material has moderate viscosity and elasticity and suitably deforms without impeding the vibration of the piezoelectric film. As an example, wool felt, nonwoven fabric of wool felt including rayon or PET, a foamed material (foamed plastic) such as glass wool, polyester wool, or polyurethane, a laminate of a plurality of sheets of paper, a magnetic fluid, a coating material, and the like are exemplified.

The specific gravity of the viscoelastic supporter 106 is not particularly limited and may be appropriately selected according to the type of the viscoelastic supporter. As an example, in a case where felt is used as the viscoelastic supporter, the specific gravity thereof is preferably 50 to 500 $kg/m^3$, and more preferably 100 to 300 $kg/m^3$. In a case where glass wool is used as the viscoelastic supporter, the specific gravity thereof is preferably 10 to 100 $kg/m^3$.

The pressing member 108 is for supporting the transduction film 10 in a state of being pressed against the viscoelastic supporter 106, and is a member formed of metal, plastic, or the like in a rectangular plate shape with an opening 108*a* at the center. The pressing member 108 has the same shape as the open surface of the case 104, and the shape of the opening 108*a* is the same rectangular shape as the open portion of the case 104.

The electroacoustic transducer 100 is configured by accommodating the viscoelastic supporter 106 in the case 104, covering the case 104 and the viscoelastic supporter 106 with the transduction film 10, and fixing the pressing member 108 to the case 104 in a state in which the periphery of the transduction film 10 is brought into contact with the open surface of the case 104 by the pressing member 108.

A method of fixing the pressing member 108 to the case 104 is not particularly limited, and various known methods such as a method using screws, bolts and nuts and a method using a fixing jig are able to be used.

In the electroacoustic transducer 100, the height (thickness) of the viscoelastic supporter 106 is greater than the height of the inner surface of the case 104. That is, in a state before the transduction film 10 and the pressing member 108 are fixed, the viscoelastic supporter 106 is in a state protruding from the upper surface of the case 104.

Therefore, in the electroacoustic transducer 100, the viscoelastic supporter 106 is held in a state in which the viscoelastic supporter 106 is pressed downward by the transduction film 10 and decreases in thickness toward the peripheral portion of the viscoelastic supporter 106. That is, at least a portion of the principal surface of the transduction film 10 is held in a bent state. Accordingly, a bent portion is formed in at least a portion of the transduction film 10. In the electroacoustic transducer 100, the bent portion serves as a vibration surface. In the following description, the bent portion is also referred to as a vibration surface.

At this time, it is preferable that the entire surface of the viscoelastic supporter 106 is pressed in the surface direction of the transduction film 10 so that the thickness decreases over the entire surface. That is, it is preferable that the entire surface of the transduction film 10 is pressed and supported by the viscoelastic supporter 106.

In addition, it is preferable that the bent portion formed in this way gradually changes in curvature from the center to the peripheral portion. Accordingly, the resonance frequencies are distributed, resulting in a wider band.

In addition, in the electroacoustic transducer 100, the viscoelastic supporter 106 is in a state of being compressed more in the thickness direction as it approaches the pressing member 108. However, due to the static viscoelastic effect (stress relaxation), a constant mechanical bias can be maintained at any place of the transduction film 10. Accordingly, the stretching and contracting movement of the transduction film 10 is efficiently converted into a forward and rearward movement, so that it is possible to obtain a flat electroacoustic transducer 100 that is thin, achieves a sufficient sound volume, and has excellent acoustic properties.

In the electroacoustic transducer 100 having such a configuration, a region of the transduction film 10 corresponding to the opening 108*a* of the pressing member 108 serves as the bent portion that actually vibrates. That is, the pressing member 108 is a portion that defines the bent portion.

Here, assuming that the length of the long side of the bent portion of the transduction film 10, that is, the opening 108*a* of the pressing member 108 is La and the length of the short side thereof is Lb, the length Lb of the short side is less than or equal to 10 cm, and the length La of the long side is greater than or equal to 30 cm.

As described above, it has been hitherto proposed to use a monoaxially stretched film of PVDF as a piezoelectric film in a piezoelectric body.

However, since the piezoelectric film formed of the monoaxially stretched PVDF has an in-plane anisotropy in the piezoelectric properties thereof, when the entire peripheral portion of the film is fixed during bending, the vibration mode is disturbed, and sufficient sound volume and acoustic quality are not able to be obtained. Furthermore, since PVDF has a smaller loss tangent than a general vibration plate for a speaker such as cone paper, a strong resonance is easily generated, and near the resonance frequency determined by a radius of curvature when the film is held while being bent, a large number of peaks and dips occur on the sound pressure and frequency properties. Thus, in a lightweight and thin speaker using the piezoelectric film formed of PVDF, it is difficult to reproduce a sound with high acoustic quality.

In contrast, the present applicants suggested a transduction film including a polymer composite piezoelectric body in which piezoelectric body particles are dispersed in a viscoelastic matrix formed of a polymer material having viscoelasticity at a normal temperature, thin film electrodes formed on both surfaces of the polymer composite piezoelectric body, and protective layers formed on the surfaces of the thin film electrodes. The transduction film is able to be rigid with respect to a vibration of 20 Hz to 20 kHz, and be extremely flexible with respect to a vibration of less than or equal to a few Hz and has an appropriate loss tangent with respect to the vibrations of all frequencies below 20 kHz. Therefore, the resonance points determined by the radius of curvature when the film is held while being bent are not noticeable, and the sound pressure and frequency properties become smooth. Accordingly, it is possible to reproduce a sound with high acoustic quality.

However, it could be seen that since the transduction film is a single vibration plate, there is a problem that the frequency band that is able to be reproduced with high acoustic quality and sufficient sound volume is slightly narrow.

As a result of detailed studies on this point, it could be seen that in a case where the vibration surface (bent portion) of the transduction film has a shape with high center symmetry such as a circular shape or a square shape, the vibration mode approaches a single mode, and the conversion efficiency (hereinafter, also simply referred to as "conversion efficiency") between the power in a frequency band deviating from the resonance frequency of the vibration mode and a sound (vibration) decreases, such that the frequency band that is able to be reproduced with high acoustic quality and sufficient sound volume becomes narrow.

Regarding this, in the present invention, a configuration, in which the bent portion of the transduction film 10 has a quadrangular shape in which the length Lb of the short side is less than or equal to 10 cm and the length La of the long side is greater than or equal to 30 cm, is provided. In a case where the bent portion of the transduction film has a quadrangular shape, by setting the lengths of the long side and the short side to be in the range described above, the resonance frequencies determined by the radii of curvature of the bent portion are appropriately distributed, and multiple vibration modes suitable for reproducing a sound with high acoustic quality in a wide frequency band are realized.

From a viewpoint of widening the directivity in a surface direction perpendicular to the longitudinal direction for reproduction in the hearing range with high acoustic quality and sufficient sound volume, the length Lb of the short side is preferably 1 cm to 10 cm, and more preferably 3 cm to 10 cm. In addition, the length La of the long side is preferably 30 cm to 200 cm, and more preferably 30 cm to 80 cm.

Here, in the present invention, the bent portion having the quadrangular (rectangular) shape includes a shape in which the angle formed by the adjacent sides is 90°±5°, and a shape in which the angle formed by the opposing sides is ±5°.

Furthermore, the corner of the bent portion, that is, the corner of the opening 108*a* of the pressing member 108 may be R-chamfered or C-chamfered. For example, by using the radius of the R-chamfer as half of the length of the short side, the bent portion may have a rounded rectangle shape consisting of two parallel lines having the same length and two semicircles.

In this case, the lengths of the long side and the short side of the quadrangular shape before the chamfering are respectively used as those of the long side La and the short side Lb of the bent portion.

In the example illustrated in FIG. 1A, the electroacoustic transducer 100 is configured to have a single bent portion. However, the electroacoustic transducer 100 is not limited thereto and may also be configured to have two or more bent portions.

Figure 2A:
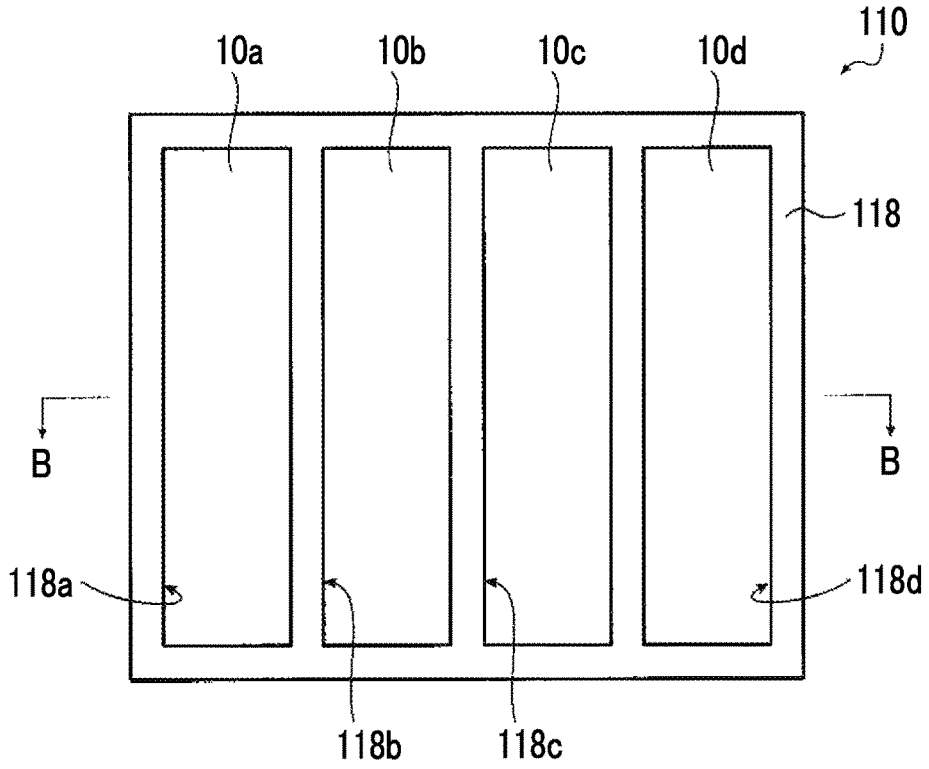
FIG. 2A is a front view conceptually illustrating another example of the electroacoustic transducer of the present invention.
Figure 2B:
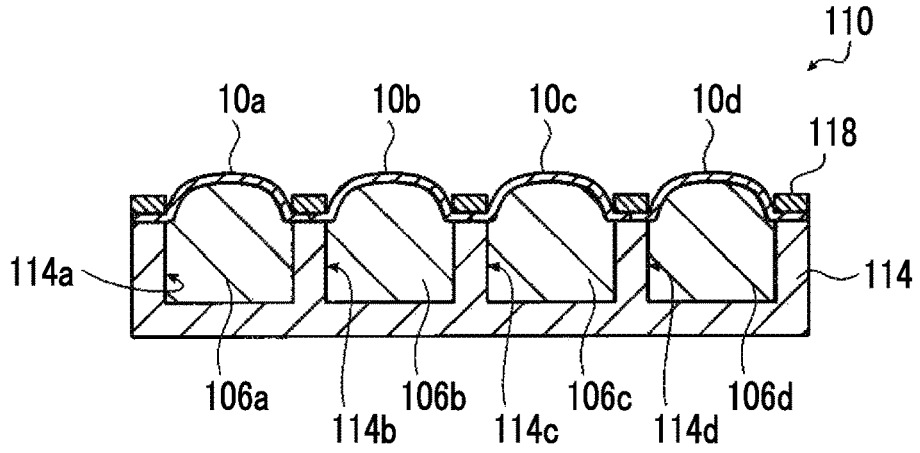
FIG. 2B is a sectional view taken along line B-B of FIG. 2A.

FIG. 2A is a front view conceptually illustrating another example of the electroacoustic transducer of the present invention, and FIG. 2B is a sectional view taken along line B-B of FIG. 2A.

The electroacoustic transducer 110 illustrated in FIGS. 2A and 2B is configured to include four transduction films 10*a* to 10*d*, a case 114, four viscoelastic supporters 106*a* to 106*d*, and a pressing member 118. The transduction films 10*a* to 10*d* and the viscoelastic supporters 106*a* to 106*d* have the same configurations as those of the transduction film 10 and the viscoelastic supporter 106 of the electroacoustic transducer 100, respectively, and thus the detailed description thereof will be omitted.

The case 114 is a case having four containers 114*a* to 114*d* in which the viscoelastic supporters 106*a* to 106*d* are respectively contained. In other words, the case 114 is a box-shaped case having an open surface, and is provided with partition walls that partition the space inside the case into four sections.

The containers 114*a* to 114*d* each have an open surface formed in a rectangular shape and are formed to be arranged in the extension directions of the short sides while the extension directions of the long sides and the extension directions of the short sides of the open surfaces are aligned.

The pressing member 118 is for supporting the transduction films 10*a* to 10*d* in a state of being respectively pressed against the viscoelastic supporters 106*a* to 106*d*, and is a plate-like member having four openings 118*a* to 118*d* formed of metal, plastic, or the like. The pressing member 118 has the same shape as the open surface of the case 114, and the shape of each of the openings 118*a* to 118*d* is a rectangular shape similar to the open surface of the containers 114*a* to 114*d* of the case 114. Therefore, the openings 118*a* to 118*d* are formed to be arranged in the extension directions of the short sides while the extension directions of the long sides and the extension directions of the short sides are aligned.

The electroacoustic transducer 110 is configured so that the viscoelastic supporters 106*a* to 106*d* are respectively contained in the containers 114*a* to 114*d* of the case 114, the viscoelastic supporters 106*a* to 106*d* are respectively covered with the transduction films 10*a* to 10*d*, and the pressing member 118 is fixed to the case 114 in a state in which the peripheries of the transduction film 10*a* to 10*d* are brought into contact with the open surface of the case 114 by the pressing member 118.

Accordingly, regions of the transduction films 10*a* to 10*d* corresponding to the openings 118*a* to 118*d* of the pressing member 118 serve as the bent portions, and the electroacoustic transducer 110 having four bent portions is configured.

Here, in the example illustrated in FIG. 2A, the configuration having the four bent portions is provided. However, the number of bent portions is not limited thereto, and a configuration having two, three, or five or more bent portions may be provided.

In the example illustrated in FIG. 2A, the sizes and shapes of a plurality of the bent portions are the same. However, the sizes and shapes of the bent portions are not limited thereto and may be different from each other.

Furthermore, in a case where a plurality of bent portions are provided, at least one bent portion may have a quadrangular shape, the length of the short side may be less than or equal to 10 cm, and the length of the long side may be greater than or equal to 30 cm. However, it is preferable that the lengths of the long sides and the short sides of all the bent portions are in the ranges described above.

In the example illustrated in FIG. 2A, one pressing member 118 has the four openings 118*a* to 118*d* and is configured to support the four transduction films 10*a* to 10*d*. However, the pressing member 118 is not limited thereto, and a configuration in which four pressing members each having a single opening are provided and the pressing members respectively support the transduction films 10*a* to 10*d* may be provided.

In the example illustrated in FIG. 2A, the configuration having the four transduction films 10*a* to 10*d*, the four viscoelastic supporters 106*a* to 106*d*, the case 114 having the four containers 114*a* to 114*d*, and the pressing member 118 having the four openings 118*a* to 118*d* are provided corresponding to the four bent portions. However, the number thereof is not limited thereto, and the transduction films, the viscoelastic supporters, and the containers may not correspond to the number of vibration surfaces as long as a plurality of bent portions can be defined.

Figure 3:
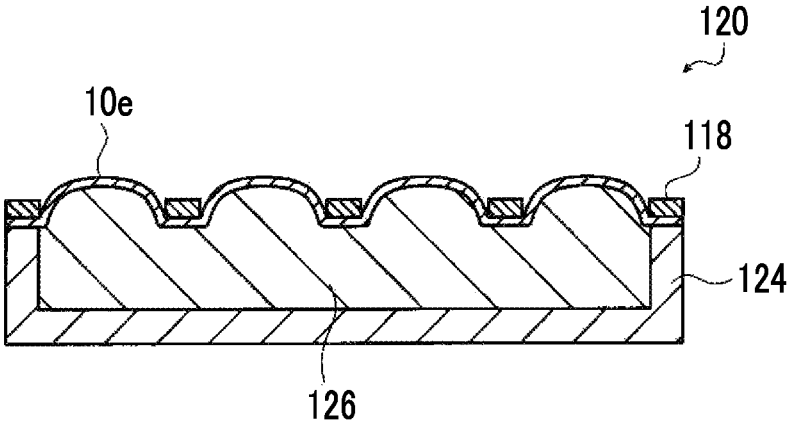
FIG. 3 is a schematic sectional view of another example of the electroacoustic transducer of the present invention.

For example, as in an electroacoustic transducer 120 illustrated in FIG. 3, a configuration which defines four bent portions by including a single transduction film 10*e* having a size including four bent portions, a single viscoelastic supporter 126, a case 124 having a single container, and a pressing member 118 having four openings may be provided.

In addition, in the electroacoustic transducer 100, the pressing force of the viscoelastic supporter 106 against the transduction film 10 is not particularly limited, and is 0.005 to 1.0 MPa and particularly preferably about 0.02 to 0.2 MPa at a position where the surface pressure is low.

The height difference of the transduction film 10 assembled into the electroacoustic transducer 100, that is, in the illustrated example, the distance between the point nearest to the bottom surface of the pressing member 108 and the point furthest therefrom is not particularly limited, and is 1 to 50 mm and particularly preferably about 5 to 20 mm from a viewpoint of allowing the transduction film 10 to sufficiently perform an upward and downward movement.

Moreover, although the thickness of the viscoelastic supporter 106 is not particularly limited, the thickness thereof before being pressed is 1 to 100 mm, and particularly preferably 10 to 50 mm.

An O-ring or the like may be interposed between the case 104 and the transduction film 10. With this configuration, a damper effect is able to be achieved, and it is possible to prevent the vibration of the transduction film 10 from being transmitted to the case 104, and to obtain excellent acoustic properties.

In the illustrated example, the configuration in which the viscoelastic supporter 106 having viscoelasticity is used is provided, but is not limited thereto, and a configuration using an elastic supporter having at least elasticity may be provided.

For example, a configuration including an elastic supporter having elasticity instead of the viscoelastic supporter 106 may be provided.

As the elastic supporter, natural rubber and various synthetic rubbers are exemplified.

Alternatively, for example, a configuration in which an airtight material having the same shape as that of the case 104 is used as a case, the open end of the case is covered and closed by the transduction film 10, gas is introduced into the case to apply a pressure to the transduction film 10, and the transduction film 10 is thus held in a convexly swollen state may be provided.

That is, a configuration in which gas under pressure is used as the elastic supporter may be provided.

In a case of a configuration in which the internal pressure is increased, asymmetry of vibration increases, resonance frequencies increase, and acoustic quality is easily affected. On the other hand, in a case of the configuration in which the transduction film 10 is held by the viscoelastic supporter formed of glass wool, felt, or the like while being bent, the acoustic quality is less likely to be affected, which is suitable.

In addition, the case may be filled with those other than the gas, and a magnetic fluid or a coating material is able to be used as long as appropriate viscosity and elasticity are able to be imparted.

Alternatively, the transduction film 10 itself may be molded in advance into a convex shape or a concave shape. In that time, the entirety of the transduction film 10 may be molded into a convex shape or a concave shape, or a portion of the transduction film may be molded into a convex portion (concave portion). A forming method of the convex portion is not particularly limited, and various known processing methods of resin films are able to be used. For example, the convex portion is able to be formed by a vacuum pressure molding method or a forming method such as embossing.

Furthermore, a configuration in which a plurality of convex portions are formed in the transduction film 10 in advance and the transduction film has a plurality of bent portions may be provided.

Moreover, the configuration using the viscoelastic supporter 106, the configuration in which a pressure is applied to the inside, and the configuration in which the convex portion is formed may be appropriately combined.

Figure 4A:
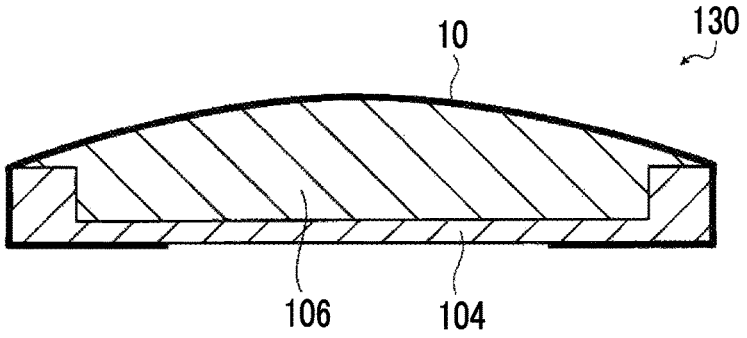
FIG. 4A is a schematic sectional view of another example of the electroacoustic transducer of the present invention.
Figure 4B:
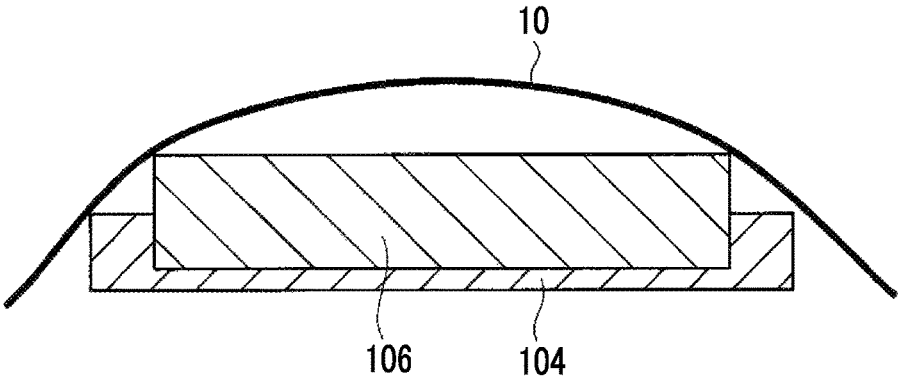
FIG. 4B is a view for explaining FIG. 4A.
Figure 4C:
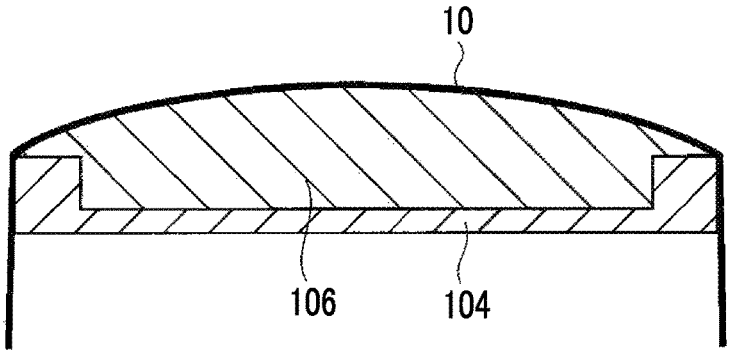
FIG. 4C is a view for explaining FIG. 4A.

In the example illustrated in FIG. 1A, the configuration in which the transduction film 10 is pressed against the viscoelastic supporter 106 so as to be supported using the pressing member 108 is provided, but is not limited thereto. For example, as illustrated in FIG. 4A, a configuration in which the end portion of the transduction film is fixed to the rear surface side of the case 104 using the transduction film 10 which is larger than the open surface of the case 104 may be provided. That is, as illustrated in FIG. 4B, the case 104 and the viscoelastic supporter 106 disposed in the case 104 may be covered with the transduction film 10 which is larger than the open surface of the case 104, the end portion of the transduction film 10 may be pulled toward the rear surface side of the case 104 so the transduction film 10 is pressed against the viscoelastic supporter 106 to be bent with a tension as illustrated in FIG. 4C, and the end portion of the transduction film may be fixed to the rear surface side of the case 104 to form an electroacoustic transducer 130 as illustrated in FIG. 4A.

In addition, when the electroacoustic transducer of the present invention is driven as a speaker, an input signal level may be corrected for each frequency band according to the frequency properties of the electroacoustic transducer.

Next, an electroacoustic transduction film used in the electroacoustic transducer of the present invention will be described.

Figure 5:
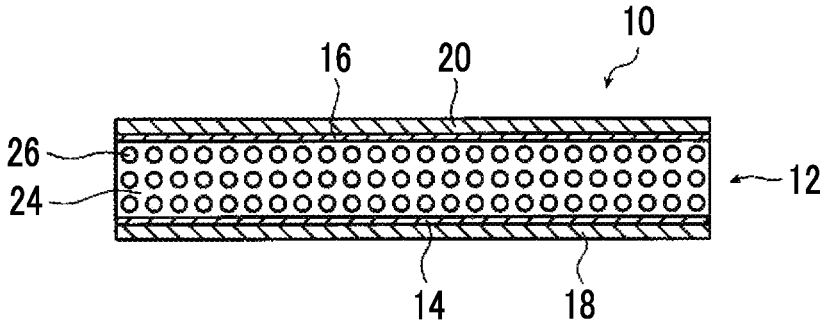
FIG. 5 is a sectional view conceptually illustrating an example of an electroacoustic transduction film of the present invention.

FIG. 5 is a sectional view conceptually illustrating an example of the transduction film 10.

As illustrated in FIG. 5, the transduction film 10 includes a piezoelectric layer 12 which is a sheet-like material having piezoelectric properties, a lower thin film electrode 14 laminated on one surface of the piezoelectric layer 12, a lower protective layer 18 laminated on the lower thin film electrode 14, an upper thin film electrode 16 laminated on the other surface of the piezoelectric layer 12, and an upper protective layer 20 laminated on the upper thin film electrode 16.

In the transduction film 10, the piezoelectric layer 12 which is a polymer composite piezoelectric body, as conceptually illustrated in FIG. 5, is a polymer composite piezoelectric body in which piezoelectric body particles 26 are uniformly dispersed in a viscoelastic matrix 24 formed of a polymer material having viscoelasticity at a normal temperature. Furthermore, herein, the "normal temperature" indicates a temperature range of approximately 0° C. to 50° C.

Although described later, the piezoelectric layer 12 is preferably subjected to polarization processing.

The transduction film 10 is suitably used as a speaker which is required to be reduced in weight and thickness, such as a speaker for a thin TV, or the like. Here, it is preferable that the transduction film 10 has the following requisites.

(i) Flexibility

For example, when the electroacoustic transducer of the present invention is assembled, the transduction film is pressed by the pressing member such that the bent portion is formed. At this time, when the transduction film is hard, large bending stress is generated to that extent, and a crack is generated on the interface between the polymer matrix and the piezoelectric body particles particularly in the vicinity of the pressing member, possibly leading to breakage. Accordingly, the transduction film is required to have suitable flexibility. In addition, when strain energy is diffused to the outside as heat, the stress is able to be relieved. Accordingly, the loss tangent of the polymer composite piezoelectric body is required to be suitably large.

(ii) Acoustic Quality

In the speaker, the piezoelectric body particles vibrate at a frequency of an audio band of 20 Hz to 20 kHz, and the entire vibration plate (the transduction film) integrally vibrates due to the vibration energy such that a sound is reproduced. Accordingly, in order to increase the transmission efficiency of the vibration energy, the transduction film is required to have suitable hardness. In addition, when the frequency properties of the speaker become smooth, the changed amount of the acoustic quality at the time of when the lowest resonance frequency $f_0$ changes according to a change in the curvature also decreases. Accordingly, the loss tangent of the transduction film is required to be suitably large.

As described above, the transduction film used in the electroacoustic transducer of the present invention is required to be rigid with respect to a vibration of 20 Hz to 20 kHz, and be flexible with respect to deformation at a slow vibration from the outside. In addition, the loss tangent of the transduction film is required to be suitably large with respect to the vibration of all frequencies of less than or equal to 20 kHz.

In general, a polymer solid has a viscoelasticity relieving mechanism, and a molecular movement having a large scale is observed as a decrease (relief) in a storage elastic modulus (Young's modulus) or the local maximum (absorption) in a loss elastic modulus along with an increase in a temperature or a decrease in a frequency. Among them, the relief due to a microbrown movement of a molecular chain in an amorphous region is referred to as main dispersion, and an extremely large relieving phenomenon is observed. A temperature at which this main dispersion occurs is a glass transition point (Tg), and the viscoelasticity relieving mechanism is most remarkably observed.

In the polymer composite piezoelectric body (the piezoelectric layer 12), the polymer material of which the glass transition point is a normal temperature, in other words, the polymer material having viscoelasticity at a normal temperature is used in the matrix, and thus the polymer composite piezoelectric body which is rigid with respect to a vibration of 20 Hz to 20 kHz and is flexible with respect to a vibration of less than or equal to a few Hz is realized. In particular, from a viewpoint of preferably exhibiting such behavior, it is preferable that a polymer material of which the glass transition temperature at a frequency of 1 Hz is a normal temperature, that is, 0° C. to 50° C. is used in the matrix of the polymer composite piezoelectric body.

As the polymer material having viscoelasticity at a normal temperature, various known materials are able to be used. Preferably, a polymer material of which the local maximum value of a loss tangent Tan δ at a frequency of 1 Hz at a normal temperature, that is, 0° C. to 50° C. in a dynamic viscoelasticity test is greater than or equal to 0.5 is used.

Accordingly, when the transduction film is slowly bent due to an external force, stress concentration on the interface between the polymer matrix and the piezoelectric body particles at the maximum bending moment portion is relieved, and thus high flexibility is able to be expected.

In addition, it is preferable that, in the polymer material, a storage elastic modulus (E') at a frequency of 1 Hz according to the dynamic viscoelasticity measurement is greater than or equal to 100 MPa at 0° C. and is less than or equal to 10 MPa at 50° C.

Accordingly, it is possible to reduce a bending moment which is generated at the time of when the transduction film is slowly bent due to the external force, and it is possible to make the transduction film rigid with respect to an acoustic vibration of 20 Hz to 20 kHz.

In addition, it is more preferable that the relative permittivity of the polymer material is greater than or equal to 10 at 25° C. Accordingly, when a voltage is applied to the polymer composite piezoelectric body, a higher electric field is applied to the piezoelectric body particles in the polymer matrix, and thus a large deformation amount is able to be expected.

However, in consideration of ensuring excellent moisture resistance or the like, it is preferable that the relative permittivity of the polymer material is less than or equal to 10 at 25° C.

As the polymer material satisfying such conditions, cyanoethylated polyvinyl alcohol (cyanoethylated PVA), polyvinyl acetate, polyvinylidene chloride-co-acrylonitrile, a polystyrene-vinyl polyisoprene block copolymer, polyvinyl methyl ketone, polybutyl methacrylate, and the like are exemplified. In addition, as these polymer materials, a commercially available product such as Hybrar 5127 (manufactured by Kuraray Co., Ltd.) is also able to be suitably used. Among them, a material having a cyanoethyl group or cyanomethyl group is preferably used, and cyanoethylated PVA is particularly preferably used.

Furthermore, only one of these polymer materials may be used, or a plurality of types thereof may be used in combination (mixture).

The viscoelastic matrix 24 using such a polymer material having viscoelasticity at a normal temperature, as necessary, may use a plurality of polymer materials in combination.

That is, in order to adjust dielectric properties or mechanical properties, other dielectric polymer materials may be added to the viscoelastic matrix 24 in addition to the viscoelastic material such as cyanoethylated PVA, as necessary.

As the dielectric polymer material which is able to be added to the matrix 24, for example, a fluorine-based polymer such as polyvinylidene fluoride, a vinylidene fluoride-tetrafluoroethylene copolymer, a vinylidene fluoride-trifluoroethylene copolymer, a polyvinylidene fluoride-trifluoroethylene copolymer, and a polyvinylidene fluoride-tetrafluoroethylene copolymer, a polymer having a cyano group or a cyanoethyl group such as a vinylidene cyanide-vinyl acetate copolymer, cyanoethyl cellulose, cyanoethyl hydroxy saccharose, cyanoethyl hydroxy cellulose, cyanoethyl hydroxy pullulan, cyanoethyl methacrylate, cyanoethyl acrylate, cyanoethyl hydroxy ethyl cellulose, cyanoethyl amylose, cyanoethyl hydroxy propyl cellulose, cyanoethyl dihydroxy propyl cellulose, cyanoethyl hydroxy propyl amylose, cyanoethyl polyacryl amide, cyanoethyl polyacrylate, cyanoethyl pullulan, cyanoethyl polyhydroxy methylene, cyanoethyl glycidol pullulan, cyanoethyl saccharose, and cyanoethyl sorbitol, a synthetic rubber such as nitrile rubber or chloroprene rubber, and the like are exemplified.

Among them, a polymer material having a cyanoethyl group is suitably used.

Furthermore, the dielectric polymer added to the viscoelastic matrix 24 of the piezoelectric layer 12 in addition to the material having viscoelasticity at a normal temperature such as cyanoethylated PVA is not limited to one dielectric polymer, and a plurality of dielectric polymers may be added.

In addition, in order to adjust the glass transition point (Tg), a thermoplastic resin such as a vinyl chloride resin, polyethylene, polystyrene, a methacrylic resin, polybutene, and isobutylene, and a thermosetting resin such as a phenol resin, a urea resin, a melamine resin, an alkyd resin, and mica may be added in addition to the dielectric polymer material.

Furthermore, in order to improve pressure sensitive adhesiveness, a viscosity imparting agent such as rosin ester, rosin, terpene, terpene phenol, and a petroleum resin may be added.

In the viscoelastic matrix 24 of the piezoelectric layer 12, the added amount at the time of adding a polymer in addition to the viscoelastic material such as cyanoethylated PVA is not particularly limited, and it is preferable that a ratio of the added polymer to the viscoelastic matrix 24 is less than or equal to 30 vol %.

Accordingly, it is possible to exhibit properties of the polymer material to be added without impairing the viscoelasticity relieving mechanism of the viscoelastic matrix 24, and thus a preferred result is able to be obtained from a viewpoint of increasing a dielectric constant, of improving heat resistance, and of improving adhesiveness between the piezoelectric body particles 26 and the electrode layer.

The piezoelectric body particles 26 are formed of ceramics particles having a perovskite type or wurtzite type crystal structure.

As the ceramics particles configuring the piezoelectric body particles 26, for example, lead zirconate titanate (PZT), lead lanthanum zirconate titanate (PLZT), barium titanate ($BaTiO_3$), zinc oxide (ZnO), a solid solution (BFBT) of barium titanate and bismuth ferrite ($BiFe_3$), and the like are exemplified.

The particle diameter of the piezoelectric body particles 26 may be appropriately selected according to the size or usage of the transduction film 10, and is preferably 1 μm to 10 μm according to the consideration of the present inventors.

By setting the particle diameter of the piezoelectric body particles 26 to be in the range described above, a preferred result is able to be obtained from a viewpoint of making high piezoelectric properties and flexibility compatible.

In addition, in FIG. 3, the piezoelectric body particles 26 in the piezoelectric layer 12 are dispersed in the viscoelastic matrix 24 with regularity. However, the present invention is not limited thereto.

That is, in the viscoelastic matrix 24, the piezoelectric body particles 26 in the piezoelectric layer 12 are preferably uniformly dispersed, and may also be irregularly dispersed.

In the transduction film 10, a quantitative ratio of the viscoelastic matrix 24 and the piezoelectric body particles 26 in the piezoelectric layer 12 may be appropriately set according to the size in the surface direction or the thickness of the transduction film 10, the usage of the transduction film 10, properties required for the transduction film 10, and the like.

Here, according to the consideration of the present inventors, the volume fraction of the piezoelectric body particles 26 in the piezoelectric layer 12 is preferably 30% to 70%, particularly preferably greater than or equal to 50%. Therefore, the volume fraction thereof is more preferably 50% to 70%.

By setting the quantitative ratio of the viscoelastic matrix 24 and the piezoelectric body particles 26 to be in the range described above, it is possible to obtain a preferred result from a viewpoint of making high piezoelectric properties and flexibility compatible.

In addition, in the transduction film 10, the thickness of the piezoelectric layer 12 is also not particularly limited, and may be appropriately set according to the size of the transduction film 10, the usage of the transduction film 10, properties required for the transduction film 10, and the like.

Here, according to the consideration of the present inventors, the thickness of the piezoelectric layer 12 is preferably 5 μm to 300 μm, more preferably 10 to 200 μm, and particularly preferably 20 to 100 μm.

By setting the thickness of the piezoelectric layer 12 to be in the range described above, it is possible to obtain a preferred result from a viewpoint of making ensuring rigidity and appropriate flexibility compatible.

Furthermore, as described above, it is preferable that the piezoelectric layer 12 is subjected to polarization processing (poling). The polarization processing will be described below in detail.

As illustrated in FIG. 3, the transduction film 10 of the present invention has a configuration in which the lower thin film electrode 14 is formed on one surface of the piezoelectric layer 12, the lower protective layer 18 is formed thereon, the upper thin film electrode 16 is formed on the other surface of the piezoelectric layer 12, and the upper protective layer 20 is formed thereon. Here, the upper thin film electrode 16 and the lower thin film electrode 14 form an electrode pair.

In addition to these layers, the transduction film 10 may further include, for example, an electrode lead-out portion that leads out the electrodes from the upper thin film electrode 16 and the lower thin film electrode 14, and an insulating layer which covers a region where the piezoelectric layer 12 is exposed for preventing a short circuit or the like.

That is, the transduction film 10 has a configuration in which both surfaces of the piezoelectric layer 12 are interposed between the electrode pair, that is, the upper thin film electrode 16 and the lower thin film electrode 14 and this laminated body is interposed between the upper protective layer 20 and the lower protective layer 18.

The region interposed between the upper thin film electrode 16 and the lower thin film electrode 14 as described above is driven according to an applied voltage.

In the transduction film 10, the upper protective layer 20 and the lower protective layer 18 have a function of applying appropriate rigidity and mechanical strength to the piezoelectric layer 12. That is, there may be a case where, in the transduction film 10 of the present invention, the piezoelectric layer 12 consisting of the viscoelastic matrix 24 and the piezoelectric body particles 26 exhibits extremely superior flexibility under bending deformation at a slow vibration but has insufficient rigidity or mechanical strength depending on the usage. As a compensation for this, the transduction film 10 is provided with the upper protective layer 20 and the lower protective layer 18.

The upper protective layer 20 and the lower protective layer 18 are not particularly limited, and may use various sheet-like materials. As an example, various resin films are suitably exemplified. Among them, by the reason of excellent mechanical properties and heat resistance, polyethylene terephthalate (PET), polypropylene (PP), polystyrene (PS), polycarbonate (PC), polyphenylene sulfite (PPS), polymethyl methacrylate (PMMA), polyetherimide (PEI), polyimide (PI), polyamide (PA), polyethylene naphthalate (PEN), triacetylcellulose (TAC), and a cyclic olefin-based resin are suitably used.

The thicknesses of the upper protective layer 20 and the lower protective layer 18 are not particularly limited. In addition, the thicknesses of the upper protective layer 20 and the lower protective layer 18 may basically be identical to each other or different from each other.

Here, when the rigidity of the upper protective layer 20 and the lower protective layer 18 excessively increases, not only is the stretching and contracting of the piezoelectric layer 12 constrained, but also the flexibility is impaired, and thus it is advantageous when the thicknesses of the upper protective layer 20 and the lower protective layer 18 become thinner unless mechanical strength or excellent handling ability as a sheet-like material is required.

According to the consideration of the present inventors, when the thickness of each of the upper protective layer 20 and the lower protective layer 18 is less than or equal to twice the thickness of the piezoelectric layer 12, it is possible to obtain a preferred result from a viewpoint of compatibility between ensuring the rigidity and appropriate flexibility, or the like.

For example, in a case where the thickness of the piezoelectric layer 12 is 50 μm and the upper protective layer 20 and the lower protective layer 18 are formed of PET, the thickness of each of the upper protective layer 20 and the lower protective layer 18 is preferably less than or equal to 100 μm, more preferably less than or equal to 50 μm, and particularly preferably less than or equal to 25 μm.

In the transduction film 10, the upper thin film electrode (hereinafter, also referred to as an upper electrode) 16 is formed between the piezoelectric layer 12 and the upper protective layer 20, and the lower thin film electrode (hereinafter, also referred to as a lower electrode) 14 is formed between the piezoelectric layer 12 and the lower protective layer 18.

The upper electrode 16 and the lower electrode 14 are provided to apply an electric field to the transduction film 10 (the piezoelectric layer 12).

In the present invention, a forming material of the upper electrode 16 and the lower electrode 14 is not particularly limited, and as the forming material, various conductive bodies are able to be used. Specifically, carbon, graphene, palladium, iron, tin, aluminum, nickel, platinum, gold, silver, copper, chromium, molybdenum, or an alloy thereof, indium-tin oxide, and the like are exemplified. Among them, any one of copper, aluminum, gold, silver, platinum, and indium-tin oxide is suitably exemplified.

In addition, a forming method of the upper electrode 16 and the lower electrode 14 is not particularly limited, and as the forming method, various known methods such as a vapor-phase deposition method (a vacuum film forming method) such as vacuum vapor deposition or sputtering, film formation using plating, and a method of adhering a foil formed of the materials described above are able to be used.

Among them, in particular, by the reason that the flexibility of the transduction film 10 is able to be ensured, a copper or aluminum thin film formed by using the vacuum vapor deposition is suitably used as the upper electrode 16 and the lower electrode 14. Among them, in particular, the copper thin film formed by using the vacuum vapor deposition is suitably used.

The thicknesses of the upper electrode 16 and the lower electrode 14 are not particularly limited. In addition, the thicknesses of the upper electrode 16 and the lower electrode 14 may basically be identical to each other or different from each other.

Here, like the upper protective layer 20 and the lower protective layer 18 described above, when the rigidity of the upper electrode 16 and the lower electrode 14 excessively increases, not only is stretching and contracting of the piezoelectric layer 12 constrained, but also flexibility is impaired. For this reason, when the upper electrode 16 and the lower electrode 14 are in a range where electrical resistance does not excessively increase, it is advantageous when the thickness becomes thinner.

In addition, according to the consideration of the present inventors, when the product of the thicknesses of the upper electrode 16 and the lower electrode 14 and the Young's modulus is less than the product of the thicknesses of the upper protective layer 20 and the lower protective layer 18 and the Young's modulus, the flexibility is not considerably impaired, which is suitable.

For example, in a case of a combination of the upper protective layer 20 and the lower protective layer 18 formed of PET (Young's modulus: approximately 6.2 GPa) and the upper electrode 16 and the lower electrode 14 formed of copper (Young's modulus: approximately 130 GPa), when the thickness of the upper protective layer 20 and the lower protective layer 18 are 25 μm, the thickness of the upper electrode 16 and the lower electrode 14 are preferably less than or equal to 1.2 μm, more preferably less than or equal to 0.3 μm, and particularly preferably less than or equal to 0.1 μm.

As described above, the transduction film 10 has a configuration in which the piezoelectric layer 12 in which the piezoelectric body particles 26 are dispersed in the viscoelastic matrix 24 having viscoelasticity at a normal temperature is interposed between the upper electrode 16 and the lower electrode 14, and this laminated body is interposed between the upper protective layer 20 and the lower protective layer 18.

In the transduction film 10, it is preferable that the local maximum value in which the loss tangent (Tan δ) at a frequency of 1 Hz according to the dynamic viscoelasticity measurement is greater than or equal to 0.1 exists at a normal temperature.

Accordingly, even when the transduction film 10 is subjected to large bending deformation from the outside at a comparatively slow vibration of less than or equal to a few Hz, it is possible to effectively diffuse the strain energy to the outside as heat, and thus it is possible to prevent a crack from being generated on the interface between the polymer matrix and the piezoelectric body particles.

In the transduction film 10, it is preferable that the storage elastic modulus (E') at a frequency of 1 Hz according to the dynamic viscoelasticity measurement is 10 GPa to 30 GPa at 0° C., and 1 GPa to 10 GPa at 50° C.

Accordingly, the transduction film 10 is able to have large frequency dispersion in the storage elastic modulus (E') at a normal temperature. That is, the transduction film 10 is able to be rigid with respect to a vibration of 20 Hz to 20 kHz, and is able to be flexible with respect to a vibration of less than or equal to a few Hz.

In addition, in the transduction film 10, it is preferable that the product of the thickness and the storage elastic modulus (E') at a frequency of 1 Hz according to the dynamic viscoelasticity measurement is $1.0\times10^6$ N/m to $2.0\times10^6$ (1.0E+06 to 2.0E+06) N/m at 0° C., and $1.0\times10^5$ N/m to $1.0\times10^6$ (1.0E+05 to 1.0E+06) N/m at 50° C.

Accordingly, the transduction film 10 is able to have appropriate rigidity and mechanical strength within a range not impairing the flexibility and the acoustic properties of the transduction film 10.

Furthermore, in the transduction film 10, it is preferable that the loss tangent (Tan δ) at a frequency of 1 kHz at 25° C. is greater than or equal to 0.05 in a master curve obtained by the dynamic viscoelasticity measurement.

Accordingly, the frequency properties of the speaker using the transduction film 10 become smooth, and thus it is also possible to decrease the changed amount of the acoustic quality at the time of when the lowest resonance frequency $f_0$ is changed according to the change in the curvature of the speaker.

Here, as described above, the transduction film is used in the electroacoustic transducer of the present invention and is pressed by the pressing member to configure a rectangular vibration surface (bent portion) in which the length La of the long side is greater than or equal to 40 cm and the length Lb of the short side is less than or equal to 10 cm.

Therefore, in consideration of the marginal portion to be fixed to the pressing member, the length of the long side of the transduction film 10 used in the electroacoustic transducer having a single bent portion is preferably greater than or equal to 30.2 cm, and more preferably 31 cm to 32 cm. In addition, the length of the short side is preferably less than or equal to 12 cm, and more preferably 10.2 cm to 11 cm.

Hereinafter, an example of a manufacturing method of the transduction film 10 will be described with reference to FIGS. 6A to 6E.

Figure 6A:
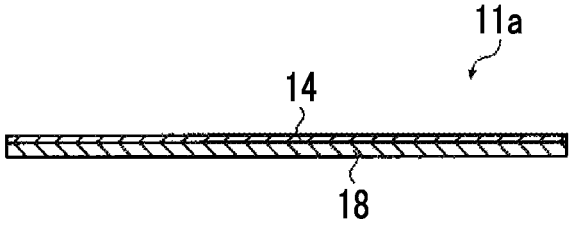
FIG. 6A is a conceptual view for explaining an example of a manufacturing method of the electroacoustic transduction film.

First, as illustrated in FIG. 6A, a sheet-like material 11*a* is prepared in which the lower electrode 14 is formed on the lower protective layer 18. The sheet-like material 11*a* may be prepared by forming a copper thin film or the like as the lower electrode 14 on the surface of the lower protective layer 18 using vacuum vapor deposition, sputtering, plating, and the like.

When the lower protective layer 18 is extremely thin, and thus the handling ability is degraded, the lower protective layer 18 with a separator (temporary supporter) may be used as necessary. As the separator, a PET film having a thickness of approximately 25 to 100 μm, and the like are able to be used. The separator may be removed after thermal compression bonding of the thin film electrode and the protective layer immediately before forming a side surface insulating layer, a second protective layer, and the like.

On the other hand, a coating material is prepared by dissolving a polymer material (hereinafter, also referred to as a viscoelastic material) having viscoelasticity at a normal temperature, such as cyanoethylated PVA, in an organic solvent, further adding the piezoelectric body particles 26 such as PZT particles thereto, and stirring and dispersing the resultant. The organic solvent is not particularly limited, and as the organic solvent, various organic solvents such as dimethylformamide (DMF), methyl ethyl ketone, and cyclohexanone are able to be used.

When the sheet-like material 11*a* described above is prepared and the coating material is prepared, the coating material is cast (applied) onto the surface of the sheet-like material, and the organic solvent is evaporated and dried. Accordingly, as illustrated in FIG. 6B, a laminated body 11*b* in which the lower electrode 14 is provided on the lower protective layer 18 and the piezoelectric layer 12 is formed on the lower electrode 14 is prepared.

A casting method of the coating material is not particularly limited, and as the casting method, all known methods (coating devices) such as a slide coater or a doctor blade are able to be used.

Figure 6B:
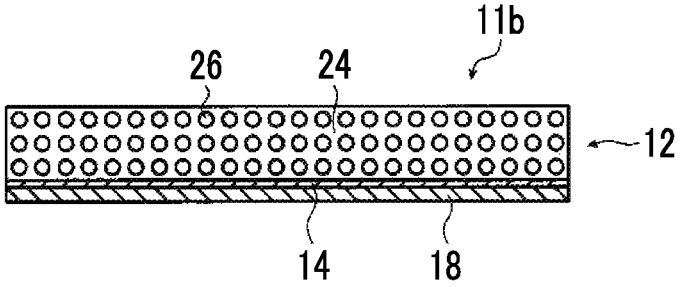
FIG. 6B is a conceptual view for explaining the example of the manufacturing method of the electroacoustic transduction film.

Alternatively, when the viscoelastic material is a material that is able to be heated and melted like cyanoethylated PVA, a melted material is prepared by heating and melting the viscoelastic material and adding and dispersing the piezoelectric body particles 26 therein, is extruded into a sheet shape on the sheet-like material 11*a* illustrated in FIG. 6A by extrusion molding or the like, and is cooled, thereby preparing the laminated body 11*b* in which the lower electrode 14 is provided on the lower protective layer 18 and the piezoelectric layer 12 is formed on the lower electrode 14 as illustrated in FIG. 6B.

In addition, as described above, in the transduction film 10, in addition to the viscoelastic material such as cyanoethylated PVA, a polymer piezoelectric material such as PVDF may be added to the viscoelastic matrix 24.

When the polymer piezoelectric material is added to the viscoelastic matrix 24, the polymer piezoelectric material added to the coating material may be dissolved. Alternatively, the polymer piezoelectric material to be added may be added to the heated and melted viscoelastic material and may be heated and melted.

When the laminated body 11*b* in which the lower electrode 14 is provided on the lower protective layer 18 and the piezoelectric layer 12 is formed on the lower electrode 14, is prepared, it is preferable that the piezoelectric layer 12 is subjected to polarization processing (poling).

A polarization processing method of the piezoelectric layer 12 is not particularly limited, and as the polarization processing method, a known method is able to be used. As a preferred polarization processing method, a method illustrated in FIGS. 6C and 6D is exemplified.

Figure 6C:
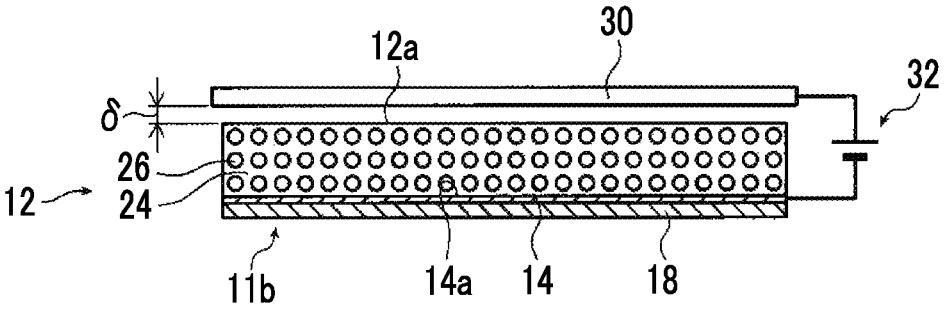
FIG. 6C is a conceptual view for explaining the method of the manufacturing method of the electroacoustic transduction film.
Figure 6D:
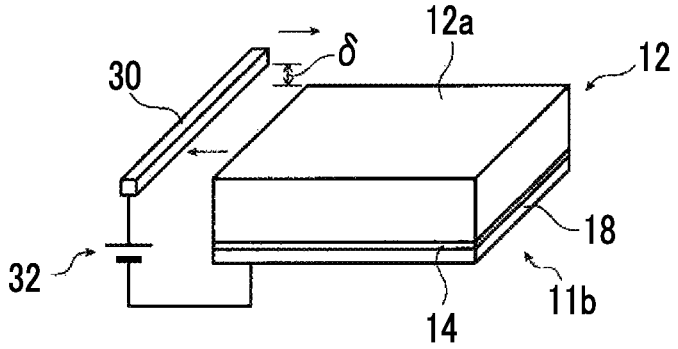
FIG. 6D is a conceptual view for explaining the method of the manufacturing method of the electroacoustic transduction film.

In this method, as illustrated in FIGS. 6C and 6D, for example, a gap g of 1 mm is opened on an upper surface 12*a* of the piezoelectric layer 12 of the laminated body 11*b*, and a rod-like or wire-like corona electrode 30 which is able to be moved along the upper surface 12*a* is disposed. Then, the corona electrode 30 and the lower electrode 14 are connected to a direct-current power source 32.

Furthermore, heating means for heating and holding the laminated body 11*b*, for example, a hot plate, is prepared.

Then, in a state where the piezoelectric layer 12 is heated and held by the heating means, for example, at a temperature of 100° C., a direct-current voltage of a few kV, for example, 6 kV, is applied between the lower electrode 14 and the corona electrode 30 from the direct-current power source 32, and thus a corona discharge occurs. Furthermore, in a state where the gap g is maintained, the corona electrode 30 is moved (scanned) along the upper surface 12*a* of the piezoelectric layer 12, and the piezoelectric layer 12 is subjected to the polarization processing.

During the polarization processing using the corona discharge (hereinafter, for convenience, also referred to as corona poling processing), known rod-like moving means may be used to move the corona electrode 30.

In addition, in the corona poling processing, a method of moving the corona electrode 30 is not limited. That is, the corona electrode 30 is fixed, a moving mechanism for moving the laminated body 11*b* is provided, and the polarization processing may be performed by moving the laminated body 11*b*. Moving means for a known sheet-like material may be used to move the laminated body 11*b*.

Furthermore, the number of corona electrodes 30 is not limited to one, and the corona poling processing may be performed by using a plurality of lines of corona electrodes 30.

In addition, the polarization processing is not limited to the corona poling processing, and normal electric field poling in which a direct-current electric field is directly applied to an object to be subjected to the polarization processing may also be used. However, in a case where this normal electric field poling is performed, it is necessary that the upper electrode 16 is formed before the polarization processing.

Before the polarization processing, calender processing may be performed to smoothen the surface of the piezoelectric layer 12 using a heating roller or the like. By performing the calender processing, a thermal compression bonding process described below is able to be smoothly performed.

In this way, while the piezoelectric layer 12 of the laminated body 11*b* is subjected to the polarization processing, a sheet-like material 11*c* is prepared in which the upper electrode 16 is formed on the upper protective layer 20. This sheet-like material 11*c* may be prepared by forming a copper thin film or the like as the upper electrode 16 on the surface of the upper protective layer 20 using vacuum vapor deposition, sputtering, plating, and the like.

Figure 6E:
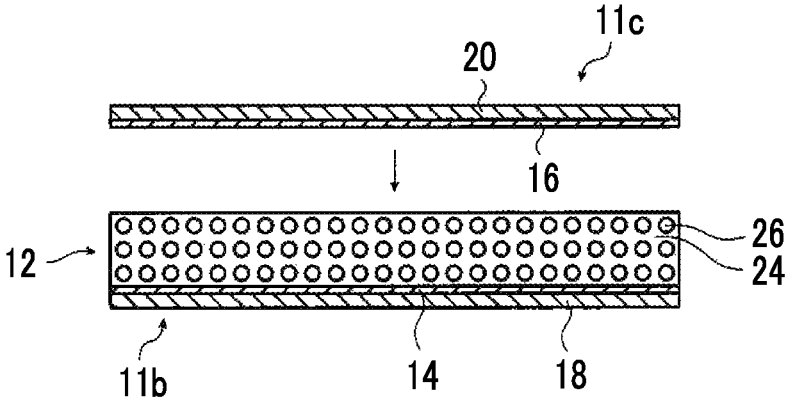
FIG. 6E is a conceptual view for explaining the method of the manufacturing method of the electroacoustic transduction film.

Next, as illustrated in FIG. 6E, the sheet-like material 11*c* is laminated on the laminated body 11*b* in which the piezoelectric layer 12 is subjected to the polarization processing while the upper electrode 16 faces the piezoelectric layer 12.

Furthermore, a laminated body of the laminated body 11*b* and the sheet-like material 11*c* is interposed between the upper protective layer 20 and the lower protective layer 18, and is subjected to the thermal compression bonding using a heating press device, a heating roller pair, or the like such that the transduction film 10 is prepared.

Next, an electroacoustic transduction system having a plurality of the electroacoustic transducers will be described.

The electroacoustic transduction system of the present invention has a plurality of the electroacoustic transducers described above, and has a configuration in which the normal vectors of the bent portions of the respective electroacoustic transducers at the center points point in different directions from each other and point outward.

Figure 7:
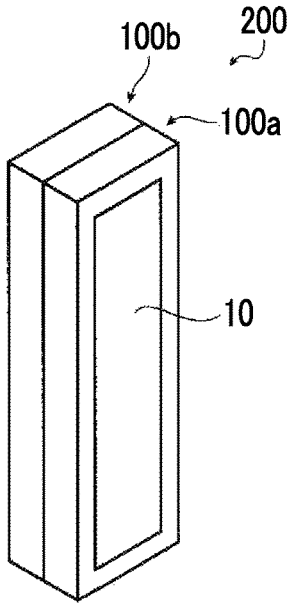
FIG. 7 is a perspective view conceptually illustrating an example of an electroacoustic transduction system which uses the electroacoustic transducer of the present invention.

FIG. 7 illustrates a schematic perspective view of an example of the electroacoustic transduction system of the present invention.

An electroacoustic transduction system 200 illustrated in FIG. 7 has two electroacoustic transducers 100*a* and 100*b* in which the surfaces of the respective electroacoustic transducers opposite to the bent portions are disposed to face each other and thus the normal vectors at the center points point in opposite directions to each other. In addition, the two electroacoustic transducers 100*a* and 100*b* are disposed so that the extension directions of the long sides and the extension directions of the short sides of the bent portions are aligned.

That is, in the electroacoustic transduction system 200, the radial direction of a sound generated by the electroacoustic transducer 100*a* and the radial direction of a sound generated by the electroacoustic transducer 100*b* are directions different from each other by 180° about the extension direction of the long sides of the bent portions.

Since the electroacoustic transducers 100*a* and 100*b* have the same configuration as the electroacoustic transducer 100 described above, the detailed description thereof will be omitted.

In general, high frequency sounds have high directivity and low frequency sounds have low directivity. That is, high frequency sounds propagate in a direction perpendicular to the vibration surface in the bent portion of the speaker, whereas low frequency sounds propagate in all directions from the vibration surface.

Therefore, in a case where a sound is reproduced by using a single electroacoustic transducer, the sound pressure level (sound volume) of low frequency sounds becomes relatively low compared to the sound pressure level of high frequency sounds on the front surface of the electroacoustic transducer (a position facing the vibration surface).

In contrast, as in an electroacoustic transduction system 200 illustrated in FIG. 7, by disposing the surfaces of the two electroacoustic transducers 100*a* and 100*b* opposite to the bent portions to face each other so as to cause the normal vectors at the center points to point in opposite directions to each other, for example, low frequency sounds among the sounds generated by the electroacoustic transducer 100*b* propagate in the radial direction of the sound of the electroacoustic transducer 100*a* on the front surface side of the electroacoustic transducer 100*a*. Accordingly, the sound pressure level of the low frequency sounds is improved and the sound pressure level in a wide frequency band can be made more uniform.

In addition, the electroacoustic transduction system 200 can emit sounds of high sound pressure levels in a wide frequency band on the front surface side of the electroacoustic transducer 100*a* and on the front surface side of the electroacoustic transducer 100*b* and is thus able to be used as an omnidirectional speaker system.

In the example illustrated in FIG. 7, the electroacoustic transduction system is configured to have two electroacoustic transducers but is not limited thereto. The electroacoustic transduction system may also be configured to have three or more electroacoustic transducers.

Figure 8:
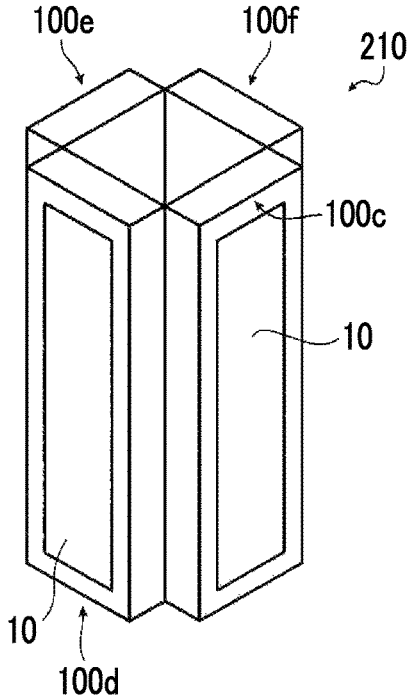
FIG. 8 is a perspective view conceptually illustrating another example of the electroacoustic transduction system which uses the electroacoustic transducer of the present invention.

FIG. 8 illustrates a schematic perspective view of another example of the electroacoustic transduction system of the present invention.

An electroacoustic transduction system 210 illustrated in FIG. 8 has four electroacoustic transducers 100*c* to 100*f*, and the respective electroacoustic transducers 100*c* to 100*f* are arranged so that the extension directions of the long sides of the bent portions are aligned, the bent portions of the respective electroacoustic transducers 100*c* to 100*f* form a substantially square shape in a cross section perpendicular to the long sides of the bent portions, and the bent portions face different directions from each other.

That is, in the electroacoustic transduction system 210, the radial direction of a sound generated by the electroacoustic transducer 100*d* is a direction different from the radial direction of a sound generated by the electroacoustic transducer 100*c* by 90° about the extension direction of the long sides of the bent portions, the radial direction of a sound generated by the electroacoustic transducer 100*e* is a direction different therefrom by 180°, and the radial direction of a sound generated by the electroacoustic transducer 100*f* is a direction different therefrom by 270°.

Since the electroacoustic transducers 100*c* to 100*f* have the same configuration as the electroacoustic transducer 100 described above, the detailed description thereof will be omitted.

In this way, in the electroacoustic transduction system, even in the configuration in which the four electroacoustic transducers are disposed to cause the radial directions of sounds to be different from each other, for example, on the front surface side of the electroacoustic transducer 100*c*, low frequency sounds among the sounds generated by each of the electroacoustic transducers 100*d* and 100*f* propagate in the radial direction of the sound generated by the electroacoustic transducer 100*c*. Accordingly, the sound pressure level of the low frequency sounds is improved and the sound pressure level in a wide frequency band can be made more uniform.

In addition, the electroacoustic transduction system 210 can emit sounds of high sound pressure levels in a wide frequency band on the front surface side of each of the electroacoustic transducers 100*c* to 100*f* and is thus able to be used as an omnidirectional speaker system.

Here, in a case of a general cone speaker, in addition to the size of a speaker unit, an enclosure that contains the speaker unit needs to have a space of a predetermined size. Therefore, when an omnidirectional speaker system is configured by combining a plurality of such cone speakers while causing the radial directions of sounds to be different from each other, an extremely large speaker system is formed.

In contrast, since the electroacoustic transducer used in the electroacoustic transduction system of the present invention is thin and lightweight, even if a plurality of the electroacoustic transducers are combined, an electroacoustic transduction system which is small and lightweight is able to be formed and is thus able to be easily used as an omnidirectional speaker system.

Here, in the example illustrated in FIG. 8, the electroacoustic transduction system in which the four electroacoustic transducers are provided and are disposed to cause the vibration surfaces of the respective electroacoustic transducers to form a substantially square shape in the cross section perpendicular to the long sides of the bent portions is provided but is not limited thereto. A configuration in which three electroacoustic transducers are provided and are disposed so as to cause the bent portions to form a substantially triangular shape in the cross section perpendicular to the long sides may also be provided. Alternatively, a configuration in which five or more electroacoustic transducers are provided and are disposed so as to cause the bent portions to form a polygonal shape in the cross section perpendicular to the long sides may also be provided. Since the length in the short side direction of the bending portion is small, as illustrated in FIG. 1C, there may be a case where the curvature thereof is small. In this case, when the bent portions are disposed to form a polygonal shape, a so-called petal shape is formed.

In addition, in a case of a configuration in which three or more electroacoustic transducers are provided and the bent portions thereof form a polygonal shape or a petal shape in a cross section perpendicular to the long sides, a configuration in which a subwoofer is disposed in the space surrounded by the three or more electroacoustic transducers to use the space as a resonance tube may be provided. Specifically, by installing an electroacoustic transducer somewhere in the resonance tube or outside the resonance tube, a subwoofer resonating at a wavelength of twice the length of the resonance tube is able to be realized.

As the electroacoustic transducer disposed in the space surrounded by the three or more electroacoustic transducers, a speaker which uses the same piezoelectric film as that of the electroacoustic transducer of the present invention or a general cone speaker may be used.

Furthermore, in the examples illustrated in FIGS. 7 and 8, the electroacoustic transduction system has a configuration in which a plurality of the electroacoustic transducers are provided and are arranged so as to cause the bent portions thereof to face different directions from each other. However, the present invention is not limited thereto, and a configuration in which the transduction film of a single electroacoustic transducer has a plurality of bent portions and the bent portions are arranged so as to cause the normal vectors at the center points to point in different directions from each other may also be provided.

For example, in the electroacoustic transduction system 200 illustrated in FIG. 7, a configuration in which a hollow box-shaped case which has rectangular open surfaces on both sides by integrating the case of the electroacoustic transducer 100*a* and the case of the electroacoustic transducer 100*b* with each other is used, the viscoelastic supporter which is greater than the case is disposed in the case, the two open surfaces are covered with the transduction films, each open surface side is pressed by the pressing member having an opening, and thus two bent portions disposed to face opposite directions to each other are formed, that is, a configuration in which two bent portions are disposed back to back may be provided.

Alternatively, in the electroacoustic transduction system 210 illustrated in FIG. 8, a configuration in which a hollow box-shaped case which has rectangular open surfaces, in which the long side directions on the four sides are aligned, by integrating the cases of the respective electroacoustic transducers 100*c* to 100*f* is used, the viscoelastic supporter which is greater than the case is disposed in the case, the four open surfaces are covered with the transduction films, each open surface side is pressed by the pressing member having an opening, and thus four bent portions are formed, that is, a configuration in which four bent portions form a polygonal shape in the cross section perpendicular to the long sides of the bent portions and are arranged so as to cause the normal vectors of the respective bent portions at the center points to point in different directions from each other may be provided.

In addition, in a case of using two or more electroacoustic transducers, the electroacoustic transducers are not limited to the configuration in which the bent portions are disposed to face different directions from each other as described above, and the vibration surfaces (the normal vectors of the bent portions at the center points) of the electroacoustic transducers may be disposed to face the same direction.

The electroacoustic transducer of the present invention and the electroacoustic transduction system are able to be suitably used as a speaker by being assembled with a flexible display such as an organic EL display. The electroacoustic transducer of the present invention and the electroacoustic transduction system may be assembled with a screen for a projector.

With such a configuration, it is possible to improve the design properties and entertainment properties of the transduction film. Further, by integrating the transduction film as a speaker with a screen or a flexible display, it is possible to reproduce a sound in a direction in which an image is displayed, and to improve a sense of realism.

In addition, the screen for a projector is flexible and is thus able to be provided with a curvature. By causing an image display surface to be provided with a curvature, it is possible to make the distance from an observer to the screen substantially uniform between the center and the end portion of the screen, and it is possible to improve a sense of realism.

In the case where the image display surface is provided with curvature as described above, distortion occurs in the projected image. Therefore, it is preferable to perform image processing on the data of the projected image so as to reduce the distortion according to the curvature of the image display surface.

As described above, the electroacoustic transducer of the present invention and the electroacoustic transduction system are described in detail, but the present invention is not limited to the examples described above, and various improvements or modifications may be performed within a range not deviating from the gist of the present invention.

EXAMPLES

Hereinafter, the present invention will be described in more detail with reference to specific examples of the present invention.

Example 1

According to the method illustrated in FIGS. 6A to 6E described above, the transduction film 10 of the present invention illustrated in FIG. 5 was prepared.

First, cyanoethylated PVA (CR-V manufactured by Shin-Etsu Chemical Co., Ltd.) was dissolved in dimethylformamide (DMF) at the following compositional ratio. Thereafter, PZT particles were added to this solution at the following compositional ratio, and were dispersed by using a propeller mixer (rotation speed 2000 rpm), and thus a coating material for forming the piezoelectric layer 12 was prepared.

PZT Particles 300 parts by mass

Cyanoethylated PVA 30 parts by mass

DMF 70 parts by mass

In addition, the PZT particles were obtained by sintering commercially available PZT raw material powder at 1000° C. to 1200° C. and thereafter crushing and classifying the resultant so as to have an average particle diameter of 5 μm.

On the other hand, the sheet-like materials 11*a* and 11*c* were prepared in which a copper thin film having a thickness of 0.1 μm was vacuum vapor deposited on a PET film having a thickness of 4 μm. That is, in this example, the upper electrode 16 and the lower electrode 14 are copper vapor deposition thin films having a thickness of 0.1 μm, and the upper protective layer 20 and the lower protective layer 18 are PET films having a thickness of 4 μm.

In order to obtain good handling ability during the process, as the PET film, a film with a separator (temporary supporter PET) having a thickness of 50 μm attached thereto was used, and the separator of each protective layer was removed after thermal compression bonding of the thin film electrode and the protective layer.

The coating material for forming the piezoelectric layer 12 prepared as described above was applied onto the lower electrode 14 of the sheet-like material 11*a* (the copper vapor deposition thin film) by using a slide coater. Furthermore, the coating material was applied such that the film thickness of the coating film after being dried was 40 μm.

Next, a material in which the coating material was applied onto the sheet-like material 11*a* was heated and dried on a hot plate at 120° C. such that DMF was evaporated. Accordingly, the laminated body 11*b* was prepared in which the lower electrode 14 made of copper was formed on the lower protective layer 18 made of PET, and the piezoelectric layer 12 (piezoelectric layer) having a thickness of 40 μm was formed thereon.

The piezoelectric layer 12 of the laminated body 11*b* was subjected to the polarization processing by corona poling illustrated in FIGS. 6C and 6D. Furthermore, the polarization processing was performed by setting the temperature of the piezoelectric layer 12 to 100° C., and applying a direct-current voltage of 6 kV between the lower electrode 14 and the corona electrode 30 so as to cause corona discharge to occur.

The sheet-like material 11*c* was laminated on the laminated body 11*b* which was subjected to the polarization processing while the upper electrode 16 (copper thin film side) faced the piezoelectric layer 12.

Next, the laminated body of the laminated body 11*b* and the sheet-like material 11*c* was subjected to thermal compression bonding at 120° C. by using a laminator device, and thus the piezoelectric layer 12 adhered to the upper electrode 16 and the lower electrode 14 such that the transduction film 10 was prepared.

The electroacoustic transducer 100 as a speaker was prepared by assembling the prepared transduction film 10 into the case 104.

Here, the size of the bent portion of the electroacoustic transducer 100 was set to 40 cm×10 cm.

That is, the case 104 is a box-shaped container having an open surface, and a plastic rectangular container having an open surface size of 400×100 mm and a depth of 9 mm, was used.

In addition, the viscoelastic supporter 106 was disposed in the case 104. The viscoelastic supporter 106 was made of glass wool having a height of 25 mm before assembly and a density of 32 kg/m$^3$.

As the pressing member 108, a plastic plate-like member in which the size of the opening 108*a* was 400×100 mm, was used.

The transduction film 10 was disposed so as to cover the viscoelastic supporter 106 and the opening of the case 104, the peripheral portion thereof was fixed by the pressing member 108 such that an appropriate tension and curvature were applied to the transduction film 10 by the viscoelastic supporter 106.

Example 2 and Comparative Examples 1 to 4

Electroacoustic transducers were prepared in the same manner as in Example 1 except that the size of the bent portion in Example 2 was set to 30 cm×10 cm and the sizes of the bent portions in Comparative Examples 1 to 4 were respectively set to 40 cm×20 cm, 20 cm×10 cm, 60 cm×20 cm, and 20 cm×5 cm, that is, only the size of the open surface of the case 104, the size of the viscoelastic supporter 106 and the size of the opening 108*a* of the pressing member 108 were changed.

[Evaluation]

<Frequency Properties>

The sound pressure level and frequency properties of the prepared electroacoustic transducer were measured by sine wave sweep measurement using a constant current type power amplifier. A measurement microphone was disposed at a position of 50 cm directly above the center of the speaker.

Figure 9A:
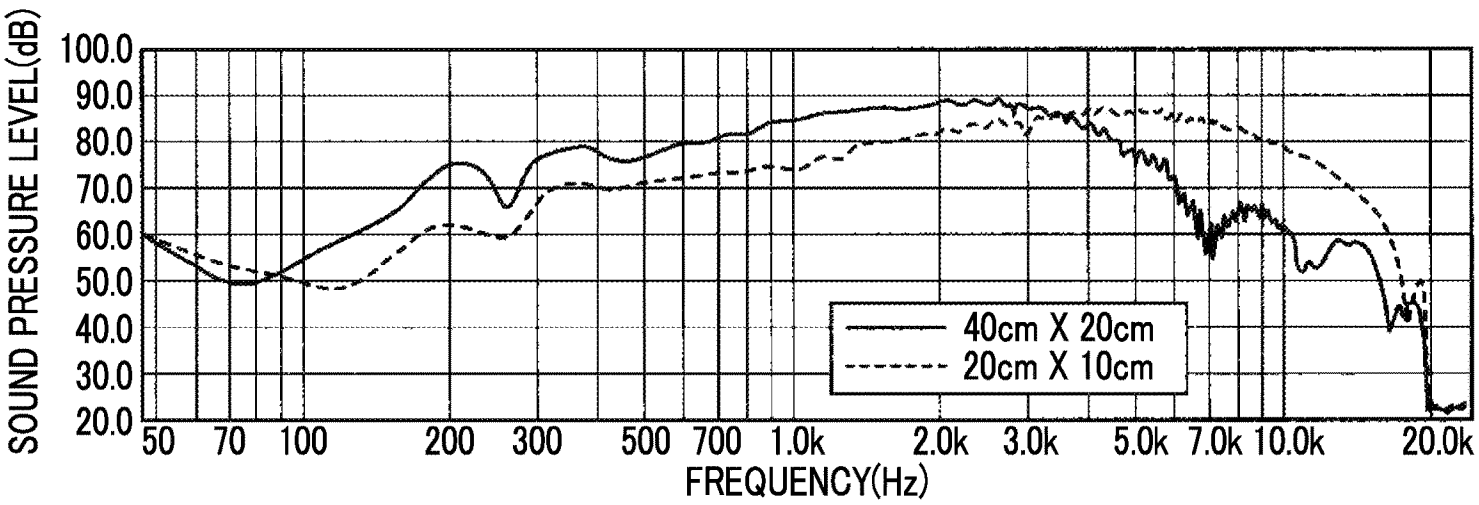
FIG. 9A is a graph showing the relationship between frequencies and sound pressure levels.
Figure 9B:
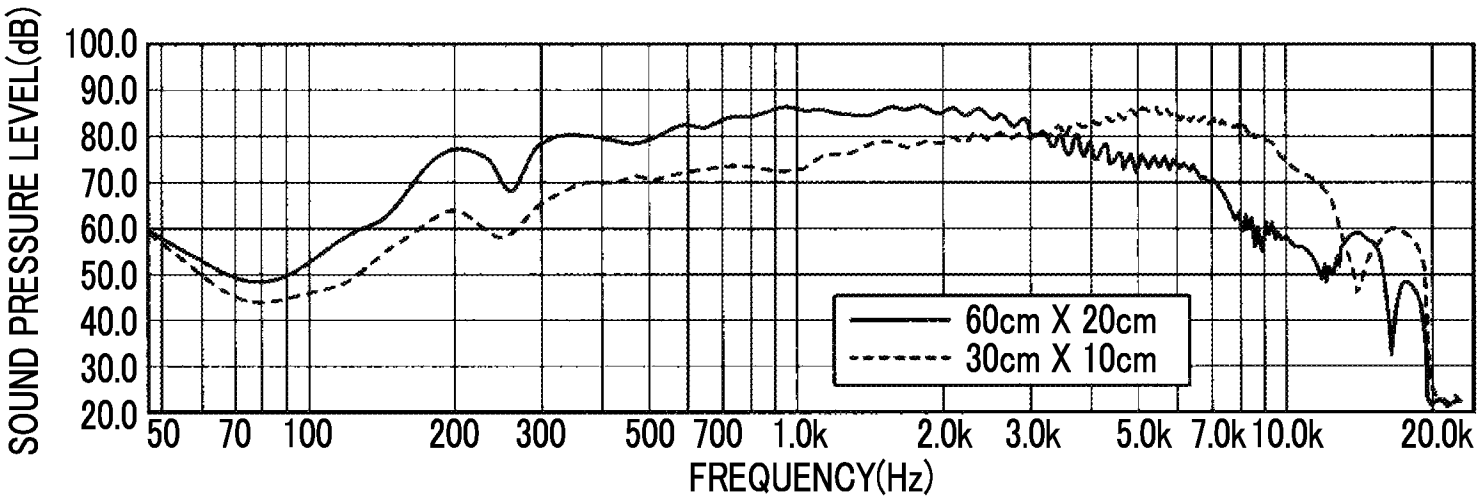
FIG. 9B is a graph showing the relationship between frequencies and sound pressure levels.
Figure 9C:
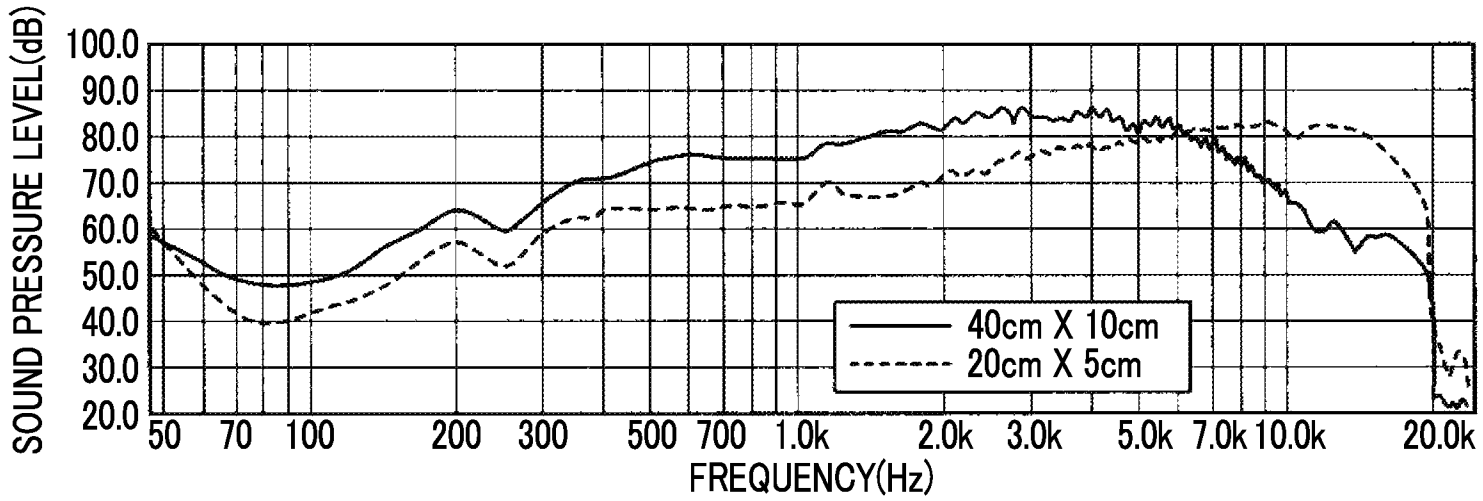
FIG. 9C is a graph showing the relationship between frequencies and sound pressure levels.

Graphs of the measurement results of the sound pressure level and frequency properties are shown in FIGS. 9A to 9C.

The graphs shown in FIGS. 9A to 9C show examples in which the ratios of the length of the long side to the length of the short side between the bent portions are the same. FIG. 9A is a graph showing the measurement results of Comparative Example 1 (40 cm×20 cm) and Comparative Example 2 (20 cm×10 cm), FIG. 9B is a graph showing the measurement results of Comparative Example 3 (60 cm×20 cm) and Example 2 (30 cm×10 cm), and FIG. 9C is a graph showing the measurement results of Example 1 (40 cm×10 cm) and Comparative Example 5 (20 cm×5 cm).

It can be seen from FIGS. 9A to 9C that the tendencies of sound pressure level and frequency properties are different even if the ratios of the length of the long side to the length of the short side between the bent portions are the same. In addition, it can be seen that in a case where the ratios of the length of the long side to the length of the short side are the same, as the lengths of the long side and the short side increase, the sound pressure level in a low frequency band is improved, and as the lengths of the long side and the short side decrease, the sound pressure level in a high frequency band is improved.

Examples 3 to 5 and Comparative Example 5

Electroacoustic transducers were prepared in the same manner as in Example 1 except that the sizes of the bent portions in Examples 3 to 5 were respectively set to 60 cm×5 cm, 40 cm×5 cm, and 60 cm×10 cm, and the size of the bent portion in Comparative Example 5 was set to 20 cm×20 cm, that is, only the size of the open surface of the case 104, the size of the viscoelastic supporter 106 and the size of the opening 108*a* of the pressing member 108 were changed.

The sound pressure level and frequency properties of each of the prepared electroacoustic transducers were measured in the same manner as described above.

Figure 10A:
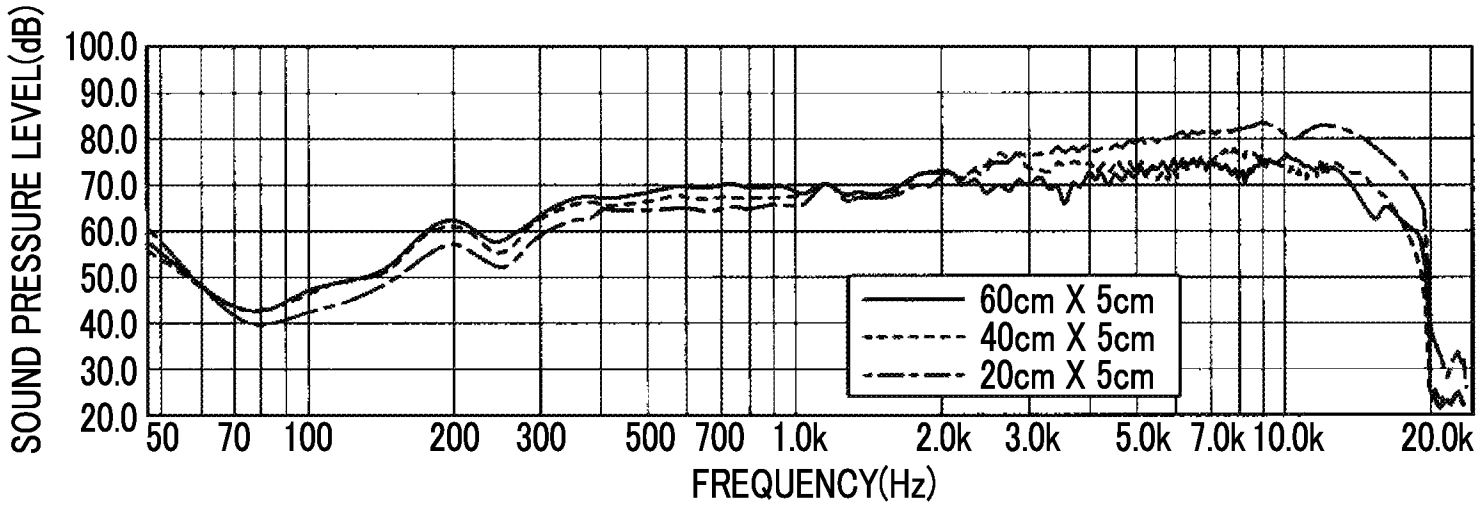
FIG. 10A is a graph showing the relationship between frequencies and sound pressure levels.
Figure 10B:
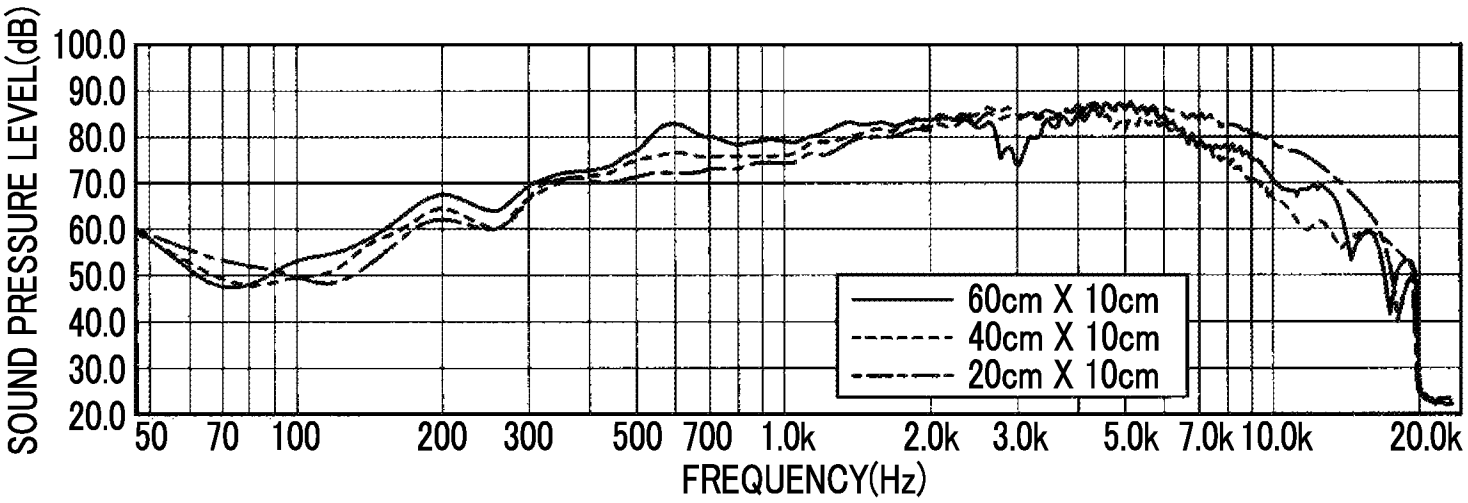
FIG. 10B is a graph showing the relationship between frequencies and sound pressure levels.
Figure 10C:
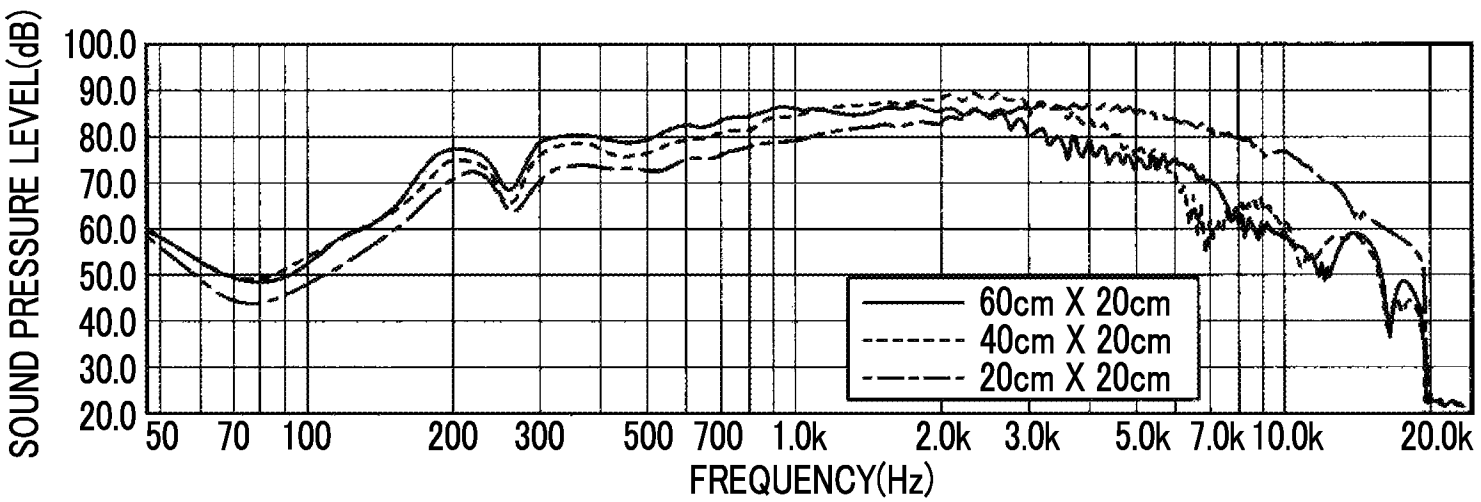
FIG. 10C is a graph showing the relationship between frequencies and sound pressure levels.

Graphs of the measurement results of the sound pressure level and frequency properties are shown in FIGS. 10A to 10C.

The graphs shown in FIGS. 10A to 10C show examples in which the lengths of the short sides of the bent portions are the same. FIG. 10A is a graph showing the measurement results of Example 3 (60 cm×5 cm), Example 4 (40 cm×5 cm), and Comparative Example 4 (20 cm×5 cm), FIG. 10B is a graph showing the measurement results of Example 5 (60 cm×10 cm), Example 1 (40 cm×10 cm), and Comparative Example 2 (20 cm×10 cm), and FIG. 10C is a graph showing the measurement results of Comparative Example 3 (60 cm×20 cm), Comparative Example 1 (40 cm×20 cm), and Comparative Example 5 (20 cm×20 cm).

It can be seen from FIGS. 10A to 10C that in the case where the lengths of the short sides of the bent portions are the same, the sound pressure level in a low frequency band is improved in a case where the length of the long side is greater than or equal to 40 cm, and the sound pressure level in a low frequency band decreases in a case where the length of the long side is 20 cm.

In addition, it can be seen from the comparison between examples in which the lengths of the long sides are the same, that is, from the comparison between Example 3 (60 cm×5 cm), Example 5 (60 cm×10 cm), and Comparative Example 3 (60 cm×20 cm), the comparison between Example 4 (40 cm×5 cm), Example 1 (40 cm×10 cm), and Comparative Example 1 (40 cm×20 cm), and the comparison between Comparative Example 4 (20 cm×5 cm), Comparative Example 2 (20 cm×10 cm), and Comparative Example 5 (20 cm×20 cm), that in the case where the lengths of the long sides of the bent portions are the same, the sound pressure level in a high frequency band is improved in a case where the length of the short side is less than or equal to 10 cm, and the sound pressure level in a high frequency band decreases in a case where the length of the short side is 20 cm.

From these examples and comparative examples, it can be seen that in a case where the length of the long side is greater than or equal to 30 cm and the length of the short side is less than or equal to 10 cm, the sound pressure level can be improved in a wide frequency band from a low frequency to a high frequency.

Next, examples of the electroacoustic transduction system having a plurality of the electroacoustic transducers will be described.

Example 6

Figure 11A:
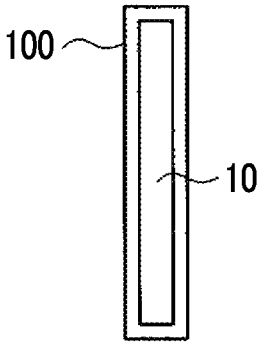
FIG. 11A is a front view conceptually illustrating an electroacoustic transducer used for sound pressure level measurement.
Figure 11B:
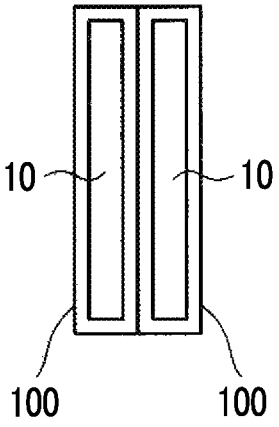
FIG. 11B is a front view conceptually illustrating an electroacoustic transducer used for sound pressure level measurement.

As Example 6, an electroacoustic transduction system (see FIG. 11B) in which two electroacoustic transducers 100 (bent portion size 60 cm×5 cm) of Example 3 are provided and the vibration surfaces (the normal vectors of the bent portions at the center points) of the two electroacoustic transducers 100 were disposed to face the same direction, was prepared.

Example 7

Figure 11C:
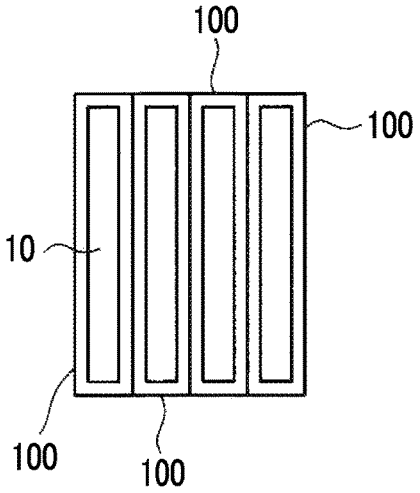
FIG. 11C is a front view conceptually illustrating an electroacoustic transducer used for sound pressure level measurement.

As Example 7, an electroacoustic transduction system (see FIG. 11C) in which four electroacoustic transducers 100 (bent portion size 60 cm×5 cm) of Example 3 are provided and the bent portions of the four electroacoustic transducers 100 are disposed to face the same direction, was prepared.

The sound pressure level and frequency properties of the prepared electroacoustic transduction systems were measured in the same manner as described above.

Figure 12A:
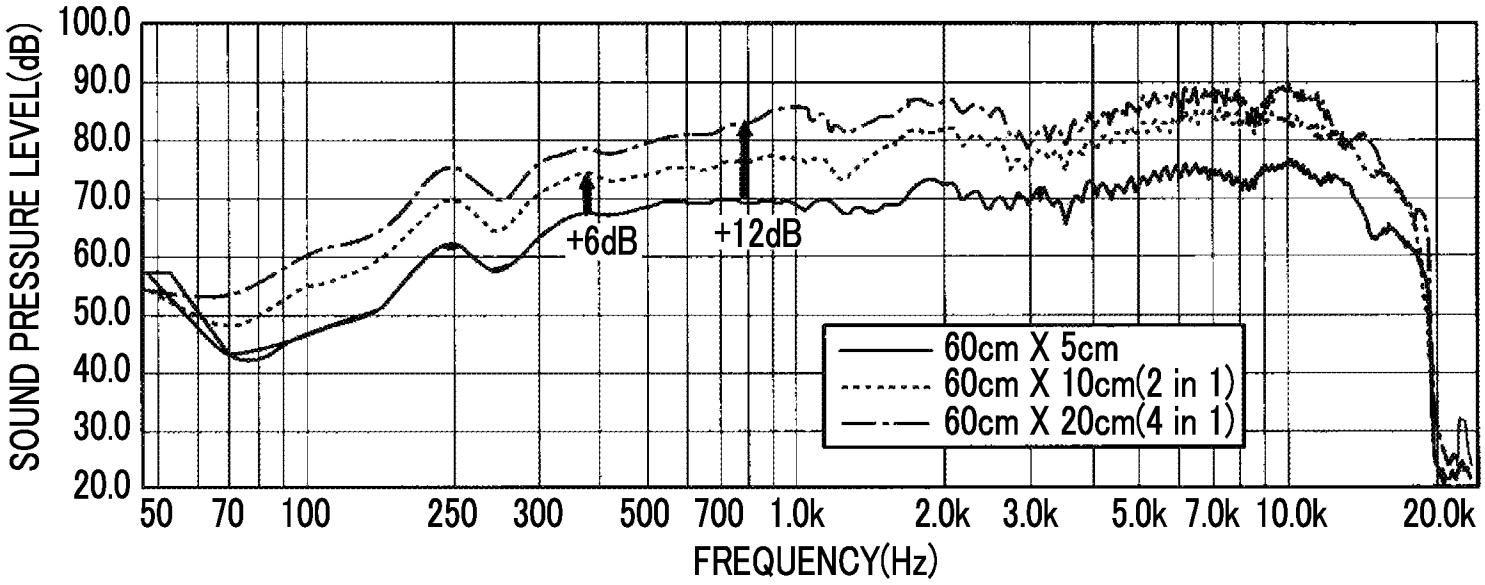
FIG. 12A is a graph showing the relationship between frequencies and sound pressure levels.

A graph for the comparison between the measurement results of the sound pressure level and frequency properties in Examples 6 and 7, and in the case of one electroacoustic transducer 100 of Example 3 (60 cm×5 cm) described above (see FIG. 11A), is shown in FIG. 12A.

As shown in FIG. 12A, it can be seen that in Example 6 having the two electroacoustic transducers 100, the sound pressure level is improved by about 6 dB in the entire frequency band, that is, by twice compared to Example 3. In addition, it can be seen that in Example 7 having the four electroacoustic transducers 100, the sound pressure level is improved by about 12 dB in the entire frequency band, that is, by four times compared to Example 3.

Figure 11D:
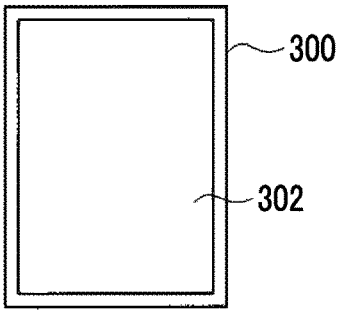
FIG. 11D is a front view conceptually illustrating an electroacoustic transducer used for sound pressure level measurement.
Figure 12B:
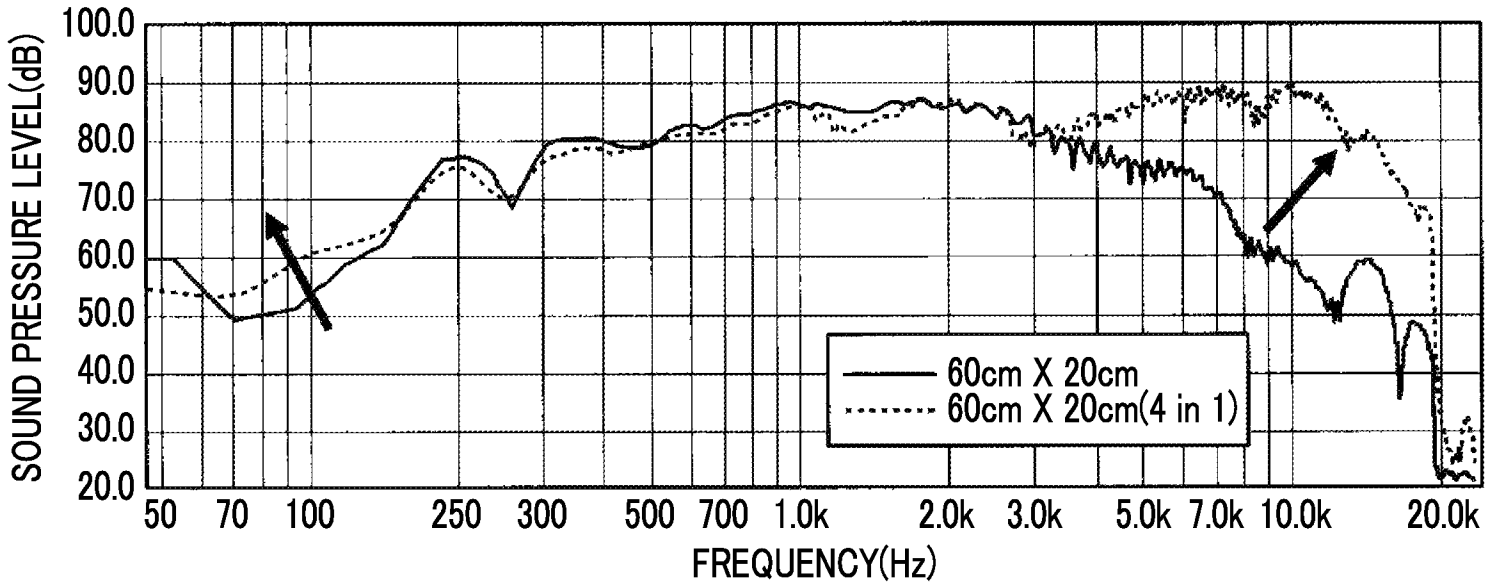
FIG. 12B is a graph showing the relationship between frequencies and sound pressure levels.

Next, a graph for the comparison between the measurement results of the sound pressure level and frequency properties in Example 7 and in the case of one electroacoustic transducer of Comparative Example 3 (60 cm×20 cm) described above (see FIG. 11D) is shown in FIG. 12B.

The area of the bent portion of the electroacoustic transduction system of Example 7 is the same as the area of the bent portion of the electroacoustic transducer 300 of Comparative Example 3. However, as shown in FIG. 12B, it can be seen that in Example 7, the sound pressure level in a low frequency band and a high frequency band is improved and a wide band can be achieved compared to Comparative Example 3.

Examples 8 and 9

Next, the sound pressure level and frequency properties of the electroacoustic transduction system 200 as illustrated in FIG. 7 as Example 8 and the electroacoustic transduction system 210 as illustrated in FIG. 8 as Example 9 were measured.

First, as a reference, the sound pressure level and frequency properties in a case where the electroacoustic transducer of Example 3 (60 cm×5 cm) was used and the electroacoustic transducer 100 was horizontally placed on a table (hereinafter, referred to as "horizontal placement") and in a case where the electroacoustic transducer 100 was vertically placed on the table (hereinafter, referred to as "vertical placement"), were measured in the same manner as described above.

Figure 13A:
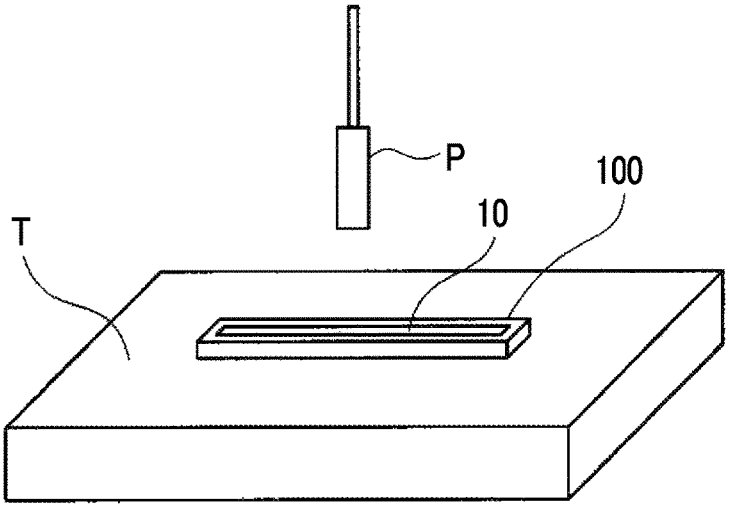
FIG. 13A is a schematic perspective view for explaining a measurement method of a sound pressure level.

In the case of horizontal placement, as illustrated in FIG. 13A, the bent portion of the electroacoustic transducer 100 was disposed on the table T while the bent portion faced upward, a microphone P was disposed facing the bent portion, and the sound pressure level and frequency properties were measured.

Figure 13B:
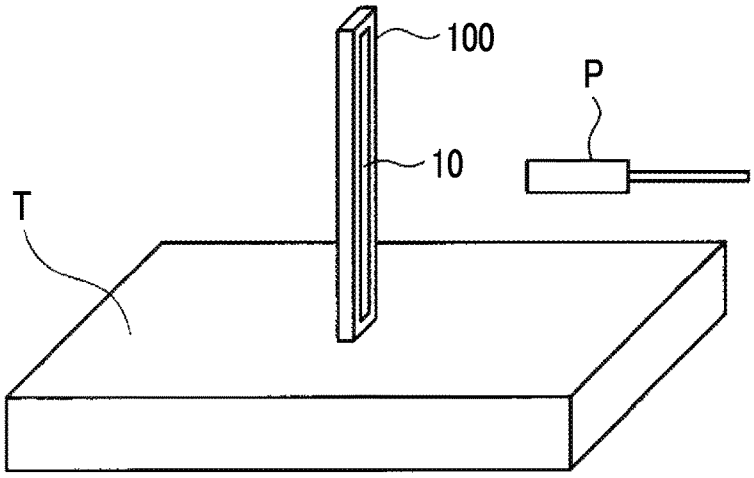
FIG. 13B is a schematic perspective view for explaining a measurement method of a sound pressure level.

In the case of vertical placement, as illustrated in FIG. 13B, the bent portion of the electroacoustic transducer 100 was disposed on the table T to face the surface direction of the table T, the microphone P was disposed facing the bent portion, and the sound pressure level and frequency properties were measured.

Figure 14:
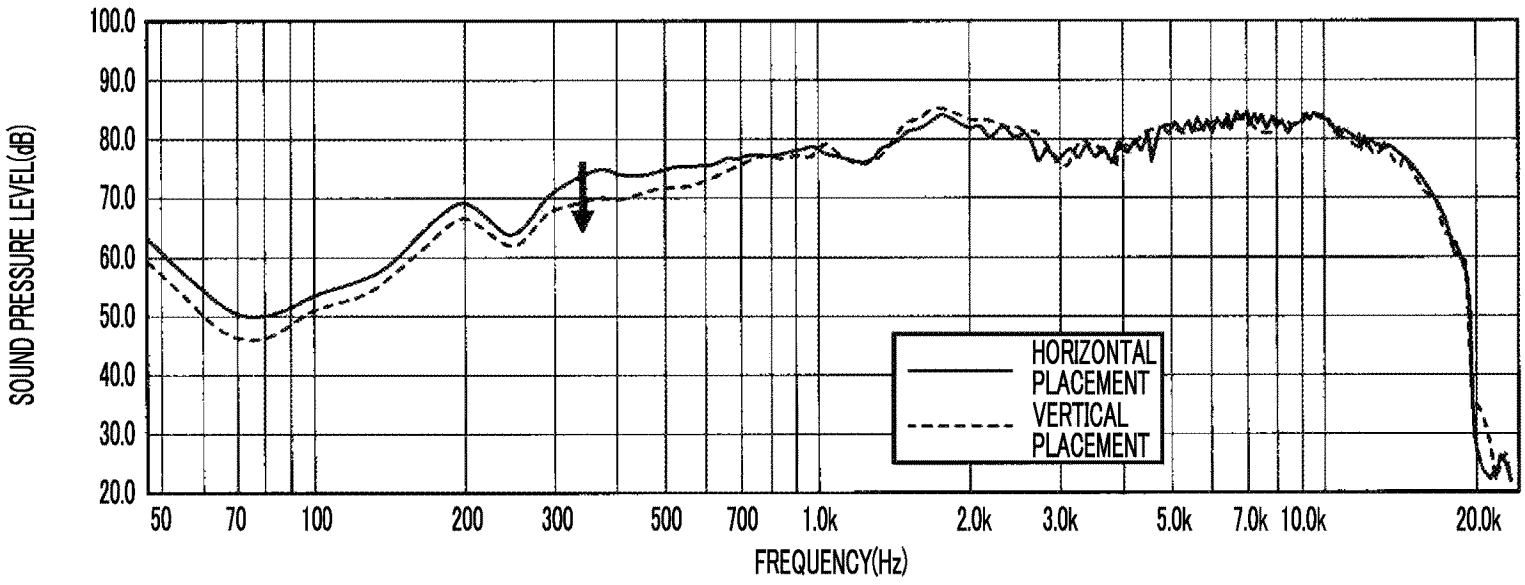
FIG. 14 is a graph showing the relationship between frequencies and sound pressure levels.

Measurement results are shown in FIG. 14.

As shown in FIG. 14, it can be seen that compared to the case of horizontal placement, in the case of vertical placement, the sound pressure level in a high frequency band is equal, but the sound pressure level in a low frequency band is lowered. This is because high frequency sounds have high directivity and propagate in a direction perpendicular to the bent portion, and thus there is no difference between the case of vertical placement and the case of horizontal placement. On the other hand, although low frequency sounds have low directivity and propagate in all directions from the bent portion, in the case of horizontal placement, the sound routed to the surface side opposite to the bent portion is reflected by the table T and thus the sound pressure level on the front surface side of the bent portion is improved compared to the case of vertical placement.

Furthermore, the disposition of the microphone P was changed for the vertical placement as illustrated in FIG. 13B, and the sound pressure level and frequency properties were measured.

Specifically, the microphone P was disposed at a position at angles of 0°, 30°, 60°, 90°, and 180° with respect to the direction perpendicular to the bent portion about the extension direction of the long side of the bent portion, and the sound pressure level and frequency properties were measured.

Figure 15:
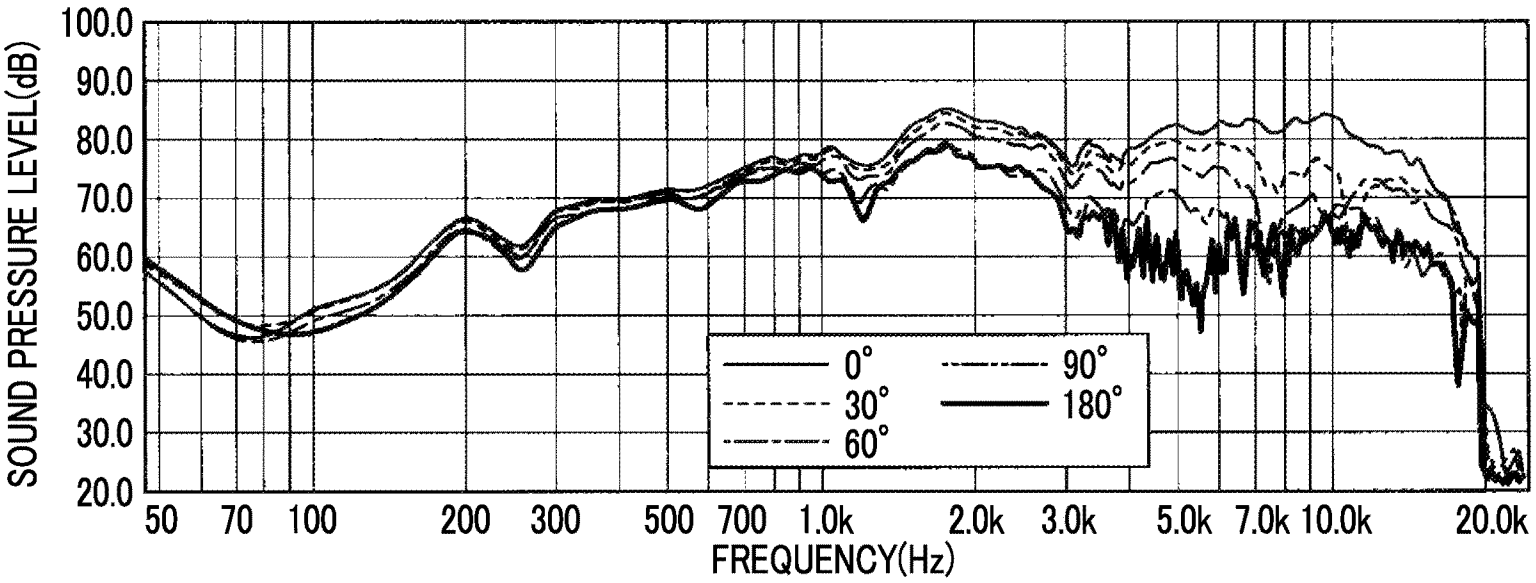
FIG. 15 is a graph showing the relationship between frequencies and sound pressure levels.

Measurement results are shown in FIG. 15.

As shown in FIG. 15, compared to the measurement result at the position on the front surface (0°) of the bent portion, in any of the cases where the position of the microphone P is changed, the decrease in the sound pressure level in a high frequency band is large, and the decrease in the sound pressure level in a low frequency band is small. It can also be seen from FIG. 15 that high frequency sounds have high directivity and propagate mainly in a direction perpendicular to the bent portion and are not routed to the surface side opposite to the bent portion and the like. On the other hand, low frequency sounds have low directivity and propagate in all directions from the bent portion, and thus the sound pressure levels on the surface side opposite to the bent portion (180°) and the front surface side of the bent portion (0°) are equal to each other.

Next, as Example 8, the electroacoustic transduction system 200 as illustrated in FIG. 7 in which two electroacoustic transducers 100 of Example 3 (60 cm×5 cm) were used and the two electroacoustic transducers 100 were disposed so that the surfaces opposite to the bent portions face each other, was prepared.

Figure 16:
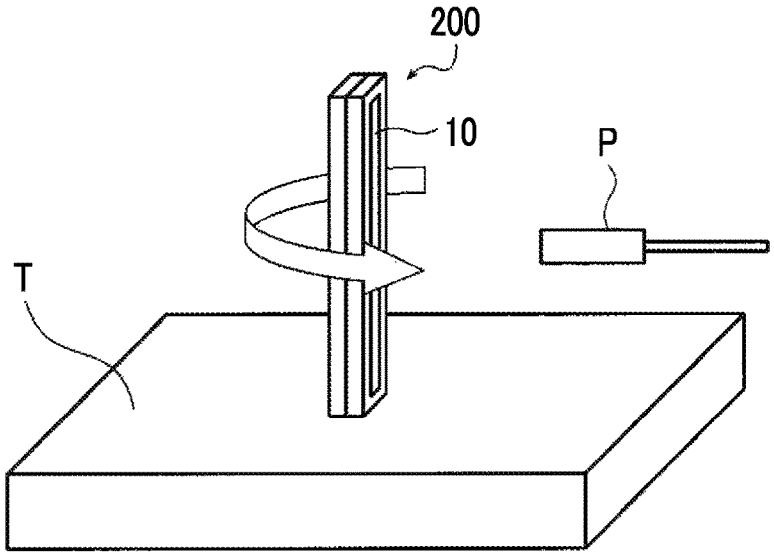
FIG. 16 is a schematic perspective view for explaining a measurement method of a sound pressure level.

As illustrated in FIG. 16, the electroacoustic transduction system 200 was vertically placed on the table T, and by changing the disposition of the microphone P to the positions at 0°, 30°, 60°, 90°, and 180°, the sound pressure level and frequency properties were measured.

Figure 17:
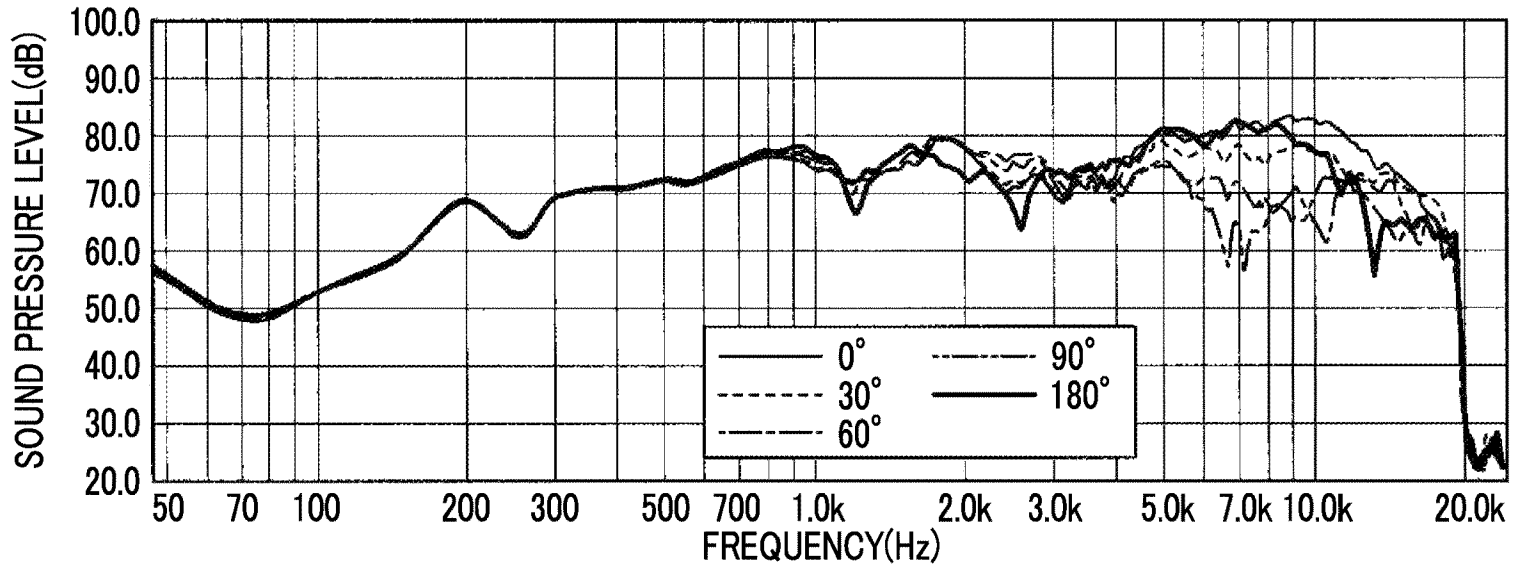
FIG. 17 is a graph showing the relationship between frequencies and sound pressure levels.

Results are shown in FIG. 17.

As Example 9, the electroacoustic transduction system 210 as illustrated in FIG. 8 in which four electroacoustic transducers 100 of Example 3 (60 cm×5 cm) were used and the four electroacoustic transducers 100 were disposed so that the extension directions of the long sides of the bent portions were aligned and the bent portions formed a quadrangular shape in the cross section perpendicular to the long sides of the bent portions, was prepared.

Figure 18:
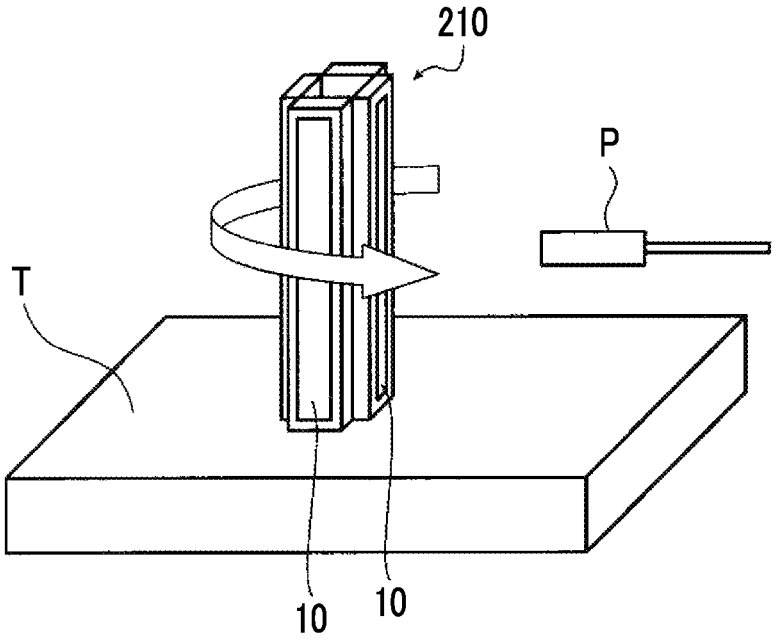
FIG. 18 is a schematic perspective view for explaining a measurement method of a sound pressure level.

As illustrated in FIG. 18, the electroacoustic transduction system 210 was vertically placed on the table T, and by changing the disposition of the microphone P to the positions at 0°, 30°, 60°, 90°, and 180°, the sound pressure level and frequency properties were measured.

Figure 19:
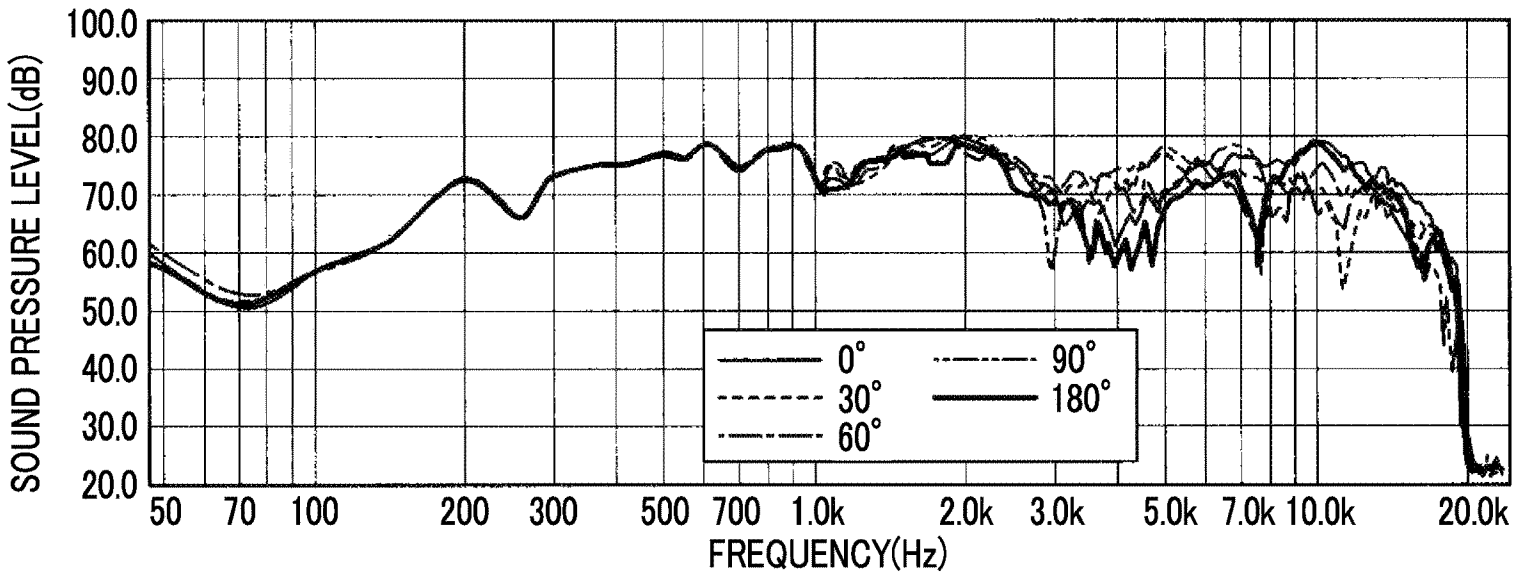
FIG. 19 is a graph showing the relationship between frequencies and sound pressure levels.

Results are shown in FIG. 19.

It can be seen from the measurement results shown in FIGS. 15, 17, and 19 that in the electroacoustic transduction system in which a plurality of the electroacoustic transducers 100 are provided, the vibration surfaces (the normal vectors of the bent portions at the center points) of the respective electroacoustic transducers 100 are disposed to face different directions from each other and face outward, compared to a case of a single electroacoustic transducer 100, the decrease in the sound pressure level at different angular positions with respect to the sound pressure level on the front surface side (0°) of the bent portion is small even in a high frequency band. That is, it can be seen that the electroacoustic transduction system has the same sound pressure level at any angle and thus can be used as an omnidirectional speaker with respect to the horizontal direction.

It can be seen from the comparison between FIGS. 15, 17, and 19 that compared to a single electroacoustic transducer 100, the electroacoustic transduction systems of Examples 7 and 8 have improved sound pressure levels in a low frequency band. This is because, on the front surface side of a certain electroacoustic transducer 100, low frequency sounds among the sounds generated by the other electroacoustic transducers 100 propagate in the radial direction of the sound of the certain electroacoustic transducer 100, and thus the sound pressure level of the low frequency sounds is improved.

However, as disclosed in ""technology for realizing "HVT method" to solve the dilemma between a property that spreads out and a property that goes straight (fourth)" in Nikkei Technology Online" (URL (Uniform Resource Locator): http://techon.nikkeibp.co.jp/article/FEATURE/20130128/262635/?ST=observer&P=1), in a case of a general dynamic electroacoustic transducer vibrating a vibration plate such as a cone paper attached to a coil, even when the vibration surfaces (the normal vectors of the bent portions at the center points) of the respective speaker units were disposed to face different directions from each other and face outward, sufficient omnidirectionality could not be realized.

Figure 21A:
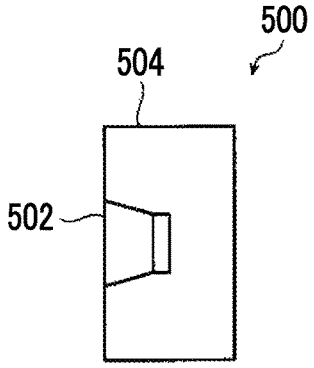
FIG. 21A is a view schematically illustrating an example of an electroacoustic transducer of the related art.
Figure 21B:
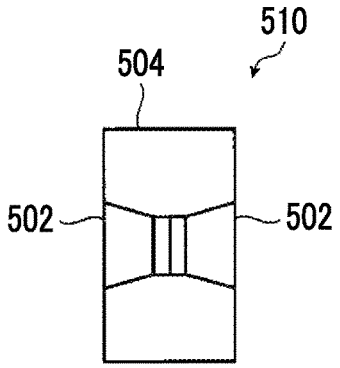
FIG. 21B is a view schematically illustrating an example of an electroacoustic transducer of the related art.
Figure 21C:
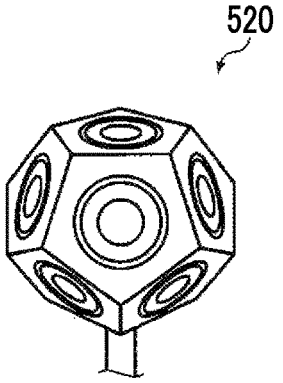
FIG. 21C is a view schematically illustrating an example of an electroacoustic transducer of the related art.

For example, regarding each of an electroacoustic transducer 500 in which a single speaker unit 502 is attached to an enclosure 504 as illustrated in FIG. 21A, an electroacoustic transducer 510 (rear surface facing arrangement) in which two speaker units 502 are attached to an enclosure so as to cause the bent portions thereof to face opposite directions to each other as illustrated in FIG. 21B, and an electroacoustic transducer 520 (polyhedral speaker) in which a speaker unit is attached to each face of a regular dodecahedron enclosure as illustrated in FIG. 21C, the results of measuring the sound pressure level by setting a certain speaker to the front surface (0°) and changing the disposition of a microphone P as described above are shown in FIGS. 22A to 22C.

Figure 22A:
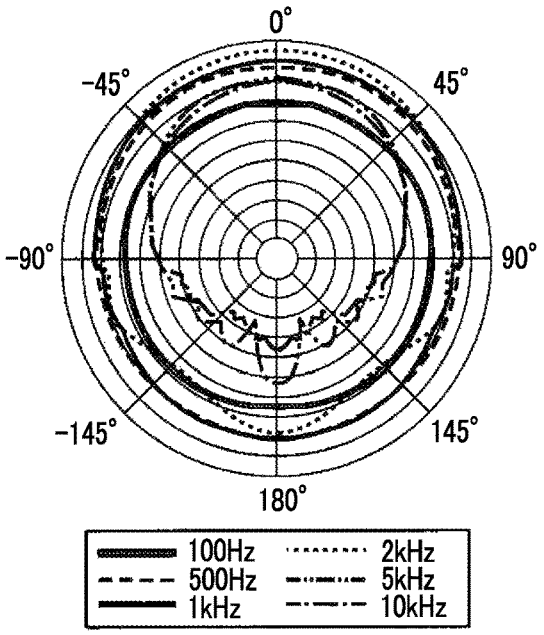
FIG. 22A is a graph showing the relationship between measurement directions and sound pressure levels.
Figure 22B:
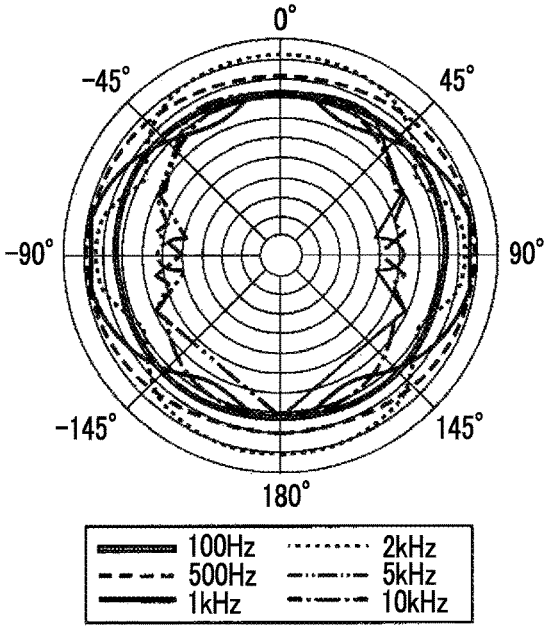
FIG. 22B is a graph showing the relationship between measurement directions and sound pressure levels.
Figure 22C:
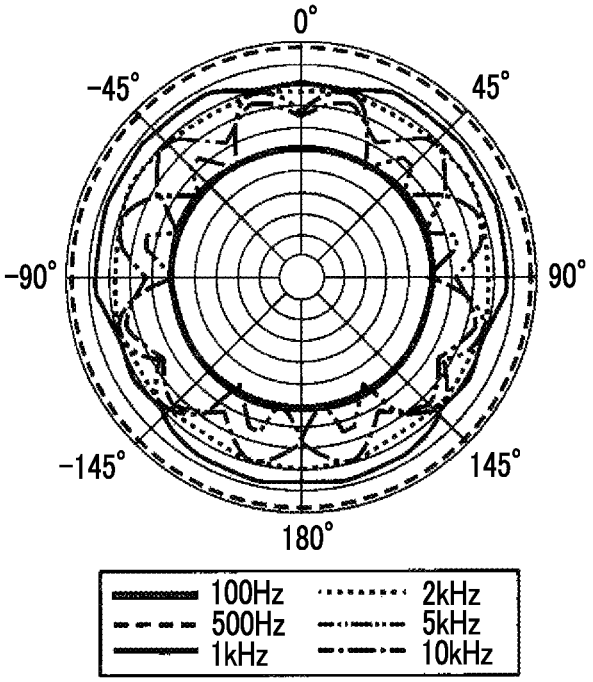
FIG. 22C is a graph showing the relationship between measurement directions and sound pressure levels.

In FIGS. 22A to 22C, a case of 100 Hz is indicated by a cross-hatched line, a case of 500 Hz is indicated by a broken line, a case of 1 kHz is indicated by a solid line, a case of 2 kHz is indicated by a dotted line, a case of 5 kHz is indicated by a two-dot chain line, and a case of 10 kHz is indicated by a one-dot chain line.

As shown in FIGS. 22A to 22C, even in the dynamic electroacoustic transducer, the sound pressure level in a mid to high range in directions other than the front surface is improved compared to the electroacoustic transducer with a single speaker unit by adopting the rear surface facing arrangement or the polyhedral speaker. However, the sound pressure level varies depending on the measurement position (angle), and thus a wave-like waveform is shown. For this reason, the balance between the sound pressure levels of a low frequency range, a middle frequency range, and a high frequency range changes at a listening position, resulting in a change in tone. Therefore, it is difficult to realize an omnidirectional speaker.

This is because the interval between the speaker units (vibration plates) is large, and the phases of sounds emitted from the respective speaker units are shifted.

In contrast, regarding each of the single electroacoustic transducer 100 illustrated in FIG. 13B, the electroacoustic transduction system 200 in which the two electroacoustic transducers illustrated in FIG. 16 are disposed to cause the normal vectors of the bent portions at the center points to face different directions from each other, and the electroacoustic transduction system 210 in which the four electroacoustic transducers illustrated in FIG. 18 are disposed to cause the bent portions to form a quadrangular shape, the results of measuring the sound pressure level by setting a certain speaker on the front surface (0°) and changing the disposition of a microphone P as described above are shown in FIGS. 20A to 20C.

Figure 20A:
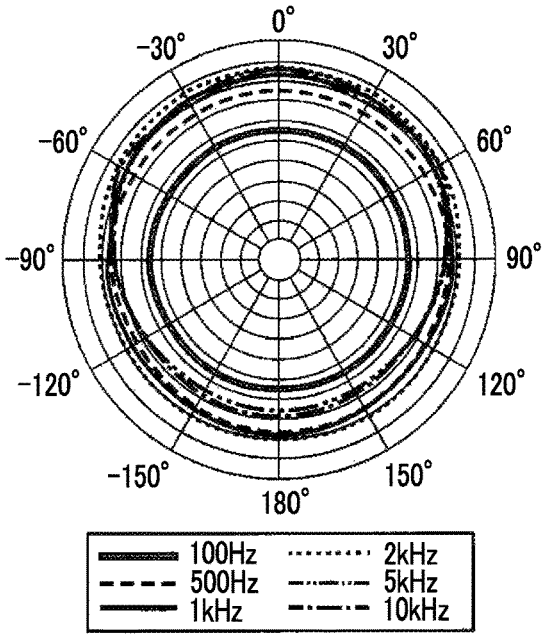
FIG. 20A is a graph showing the relationship between measurement directions and sound pressure levels.
Figure 20B:
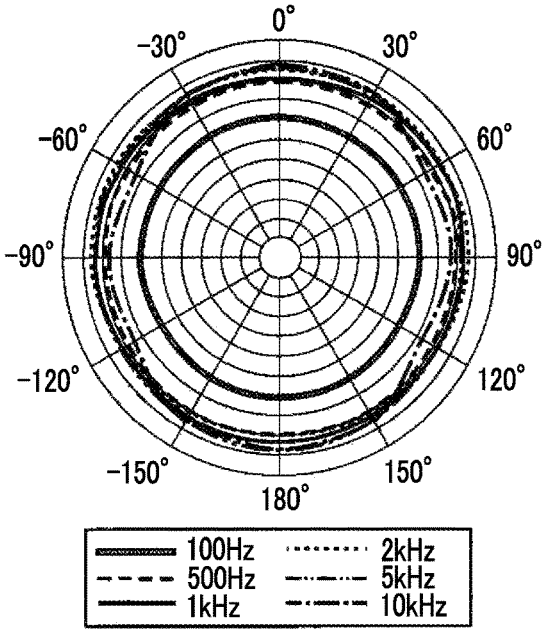
FIG. 20B is a graph showing the relationship between measurement directions and sound pressure levels.
Figure 20C:
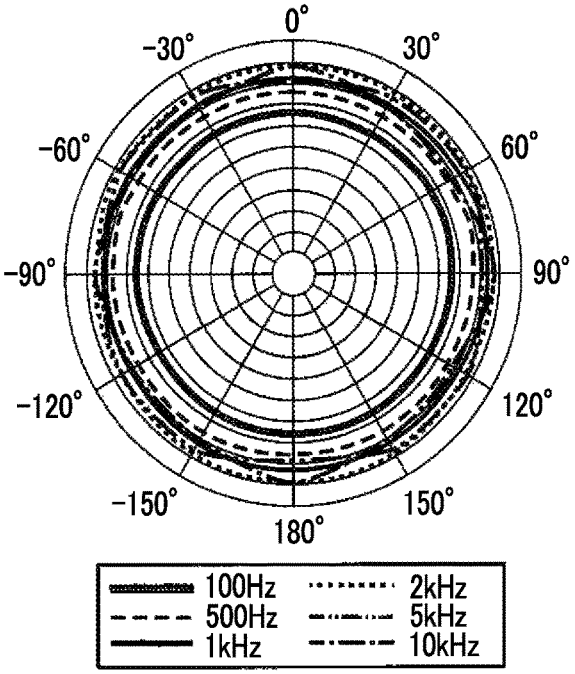
FIG. 20C is a graph showing the relationship between measurement directions and sound pressure levels.

In FIGS. 20A to 20C, a case of 100 Hz is indicated by a cross-hatched line, a case of 500 Hz is indicated by a broken line, a case of 1 kHz is indicated by a solid line, a case of 2 kHz is indicated by a dotted line, a case of 5 kHz is indicated by a two-dot chain line, and a case of 10 kHz is indicated by a one-dot chain line.

As shown in FIG. 20B, since the electroacoustic transducer of the present invention is extremely thin, even in a case where the electroacoustic transducers are disposed back to back, the distance between the vibration plates on the front surface side and the rear surface side is extremely small, and the sounds emitted from the respective electroacoustic transducers vibrate almost in phase even when the sounds propagate in any direction. Therefore, it can be seen that a uniform sound pressure level is able to be obtained in any direction, and the balance between the sound pressure levels in the low frequency range, the middle frequency range, and the high frequency range is not changed, so that sufficient omnidirectionality is obtained. In addition, since there is substantially no shift between the timings at which sounds emitted from the front surface side and the rear surface side reach the ear, there is little noise or distortion, which is suitable for hi-fi reproduction.

Furthermore, in the case of the electroacoustic transducer of the present invention, the area of the vibration plate (bent portion) can be made substantially the same as the size of the case. Therefore, even in the case where a plurality of the electroacoustic transducers are provided, the distance between the vibration plates is able to be reduced, the junction between the electroacoustic transducers is natural, the electroacoustic transducer of the present invention is extremely thin, and the short side is also short. Therefore, as in FIG. 18, even in the case where a polyhedron is formed using a plurality of the electroacoustic transducers, it is possible to shorten the distance between the vibration plates of the electroacoustic transducers on the front surface side, the side surface side, and the rear surface side. Therefore, as illustrated in FIG. 20C, sounds emitted from the respective electroacoustic transducers vibrate almost in phase even when the sounds propagate in any direction. Therefore, it can be seen that a uniform sound pressure level is able to be obtained in any direction, and the balance between the sound pressure levels in the low frequency range, the middle frequency range, and the high frequency range is not changed, so that ideal omnidirectionality is obtained in the horizontal direction (the direction perpendicular to the long side). In addition, since there is substantially no shift between the timings at which sounds emitted from the front surface side and the rear surface side reach the ear, there is little noise or distortion, which is suitable for hi-fi reproduction.

Therefore, the electroacoustic transduction system in which a plurality of the electroacoustic transducers are provided and the bent portions of the respective electroacoustic transducers are disposed to face different directions from each other and face outward has omnidirectionality with respect to the horizontal direction and is able to uniformly reproduce a sound pressure level in a wide frequency band.

From the above results, the effects of the present invention are obvious.

EXPLANATION OF REFERENCES

10, 302: electroacoustic transduction film

11*a*, 11*c*: sheet-like material

11*b*: laminated body
12: piezoelectric layer
14: lower thin film electrode
16: upper thin film electrode
18: lower protective layer
20: upper protective layer
24: viscoelastic matrix
26: piezoelectric body particles
30: corona electrode
32: direct-current power source
100, 110, 130, 300: electroacoustic transducer
104, 114, 124: case
106, 126: viscoelastic supporter
108, 118: pressing member
108*a*, 118*a* to 118*d*: opening
114*a* to 114*d*: container
200, 210: electroacoustic transduction system

What is claimed is:

1. An electroacoustic transducer comprising:

an electroacoustic transduction film including a polymer composite piezoelectric body in which piezoelectric body particles are dispersed in a viscoelastic matrix formed of a polymer material having viscoelasticity at a normal temperature, and two thin film electrodes laminated on both surfaces of the polymer composite piezoelectric body; and an elastic supporter which is disposed to be closely attached to one principal surface of the electroacoustic transduction film so as to cause at least a portion of the electroacoustic transduction film to be bent, wherein a bent portion of the electroacoustic transduction film has a quadrangular shape, a length of a short side of the bent portion is less than or equal to 10 cm, and a length of a long side thereof is greater than or equal to 30 cm, and the electroacoustic transduction film has a plurality of the bent portions which are arranged so that extension directions of long sides of the respective bent portions are aligned, the plurality of the bent portions form a polygonal shape or a petal shape in a cross section perpendicular to the long sides of the bent portions, and the normal vectors of the respective bent portions at the center points are in different directions from each other.

2. The electroacoustic transducer according to claim 1, wherein the elastic supporter is a viscoelastic supporter having viscoelasticity.

3. The electroacoustic transducer according to claim 1, wherein the bent portion formed gradually changes in curvature from a center to a peripheral portion.

4. The electroacoustic transducer according to claim 1, wherein the electroacoustic transduction film is partitioned into a plurality of regions, and the bent portion is formed in each of the regions.

5. The electroacoustic transducer according to claim 1, further comprising:

a pressing member which has at least one opening and presses the electroacoustic transduction film against the viscoelastic supporter, wherein a region of the electroacoustic transduction film corresponding to the opening of the pressing member is the bent portion, and the opening has a quadrangular shape, a length of a short side of the opening is less than or equal to 10 cm, and a length of a long side thereof is greater than or equal to 30 cm.

6. The electroacoustic transducer according to claim 5, wherein the pressing member has openings which are two or more in number.

7. The electroacoustic transducer according to claim 1, wherein the electroacoustic transduction film has one bent portion, the electroacoustic transduction film has a quadrangular shape, a length of a short side thereof is less than or equal to 12 cm, and a length of a long side thereof is greater than or equal to 30.2 cm.

8. The electroacoustic transducer according to claim 1, wherein a storage elastic modulus (E') of the electroacoustic transduction film at a frequency of 1 Hz according to dynamic viscoelasticity measurement is 10 to 30 GPa at 0° C. and 1 to 10 GPa at 50° C.

9. The electroacoustic transducer according to claim 1, wherein a glass transition temperature of the polymer material at a frequency of 1 Hz is 0° C. to 50° C.

10. The electroacoustic transducer according to claim 1, wherein, in the polymer material, a local maximum value at which a loss tangent (Tanδ) at a frequency of 1 Hz according to the dynamic viscoelasticity measurement is greater than or equal to 0.5 is present in a temperature range of 0° C. to 50° C.

11. The electroacoustic transducer according to claim 1, wherein the polymer material has a cyanoethyl group, or a cyanomethyl group.

12. The electroacoustic transducer according to claim 1, wherein the polymer material has cyanoethylated polyvinyl alcohol as a primary component.

13. An electroacoustic transduction system comprising:

a plurality of the electroacoustic transducers according to claim 1, wherein normal vectors of the bent portions of the respective electroacoustic transducers at center points point in different directions from each other and point outward.

14. The electroacoustic transduction system according to claim 13, wherein two electroacoustic transducers are provided, and the normal vectors of the bent portions of the two electroacoustic transducers at the center points point in opposite directions to each other.

15. The electroacoustic transduction system according to claim 13, wherein the plurality of the electroacoustic transducers are arranged so that extension directions of long sides of the bent portions of the respective electroacoustic transducers are aligned, the plurality of the bent portions form a polygonal shape or a petal shape in a cross section perpendicular to the long sides of the bent portions, and the normal vectors of the respective bent portions at the center points are in different directions from each other.

16. A subwoofer which uses a space surrounded by a plurality of the electroacoustic transducers in the electroacoustic transduction system according to claim 13, as a resonance tube.

17. The electroacoustic transduction system according to claim 13, further comprising:

a subwoofer mounted in a space surrounded by a plurality of the electroacoustic transducers.

* * * * *